US008656850B2

(12) United States Patent
Kawaguchi et al.

(10) Patent No.: US 8,656,850 B2
(45) **Date of Patent: *Feb. 25, 2014**

(54) PUNCH DATA GENERATING DEVICE AND COMPUTER READABLE MEDIUM STORING PUNCH DATA GENERATING PROGRAM

(75) Inventors: Yasuhiko Kawaguchi, Nagoya (JP); Yukiyoshi Muto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 720 days.

This patent is subject to a terminal disclaimer.

(21) Appl. No.: 12/902,686

(22) Filed: Oct. 12, 2010

(65) Prior Publication Data

US 2011/0088605 A1 Apr. 21, 2011

(30) Foreign Application Priority Data

Oct. 21, 2009 (JP) ..... 2009-242357

(51) Int. Cl.
*D05B 21/00* (2006.01)

(52) U.S. Cl.
USPC ..... 112/470.06

(58) Field of Classification Search
USPC ..... 112/102.5, 73, 78, 155, 221, 222, 112/470.05, 470.06, 475.05, 475.18, 112/475.19; 72/379.2, 446, 455, 464
See application file for complete search history.

(56) References Cited

U.S. PATENT DOCUMENTS 5,390,126 A * 2/1995 Kongho et al. ..... 700/138
5,810,526 A * 9/1998 Hirai ..... 409/131
5,915,316 A * 6/1999 Tajima et al. ..... 112/470.05

FOREIGN PATENT DOCUMENTS

JP A-5-96071 4/1993
JP A-11-172566 6/1999
JP A-2006-167898 6/2006

* cited by examiner

*Primary Examiner* — Tejash Patel
(74) *Attorney, Agent, or Firm* — Oliff PLC

(57) ABSTRACT

A punch data generating device generating punch data for execution with an embroiderable sewing machine including a needle bar moved up and down and mounted with a punch needle for forming penetrations on a workpiece in dot-by-dot strokes, a transfer mechanism transferring the workpiece in two directions in coordination with the movement of the punch needle to form the penetrations. The punch data generating device includes a cut data generator generating cut data constituting the punch data, the cut data being used to form the penetrations along an outline of a predetermined pattern to allow cutting of the outline; and an auxiliary cut data generator generating auxiliary cut data constituting the punch data, the auxiliary cut data being used to form penetrations contacting the outline of the pattern to form a cut that facilitates detachment of the outline from the workpiece.

13 Claims, 20 Drawing Sheets

| LINE NO. | PUNCH TYPE | LINE ELEMENTS |
|---|---|---|
| 1 | CUT | P0,P1,P2,P3,P4,P5,P6,P7 |
| 2 | DRAW | P0,P7 |
| 3 | CUT | P7,P8,P9,P10,P11,P12 |
| 4 | CUT | P12,P13,P14,P15,P16,P17,P18,P19 |
| 5 | DRAW | P12,P19 |
| 6 | CUT | P19,P0 |
| 7 | DRAW | P20,P21,P22,P23,P24,P25,P20 |
| 8 | DRAW | P26,P27,P28,P29,P30,P31,P26 |
| 9 | DRAW | P32,P33,P34,P32 |
| 10 | DRAW | P35,P36,P37,P38 |

FIG. 8A

| LINE NO. | PUNCH TYPE | LINE ELEMENTS |
|---|---|---|
| 1 | CUT | P0,P1,P2,P3,P4,P5,P6,P7 |
| 2 | DRAW | P0,P7 |
| 3 | CUT | P7,P8,P9,P10,P11,P12 |
| 4 | CUT | P12,P13,P14,P15,P16,P17,P18,P19 |
| 5 | DRAW | P12,P19 |
| 6 | CUT | P19,P0 |
| 7 | DRAW | P20,P21,P22,P23,P24,P25,P20 |
| 8 | DRAW | P26,P27,P28,P29,P30,P31,P26 |
| 9 | DRAW | P32,P33,P34,P32 |
| 10 | DRAW | P35,P36,P37,P38 |
| 11 | CUT | P14,P39,P40,P41,P41,P15 |
| 12 | CUT | P9,P43,P44,P45,P46,P10 |

FIG.8B

PUNCH DATA GENERATING DEVICE AND COMPUTER READABLE MEDIUM STORING PUNCH DATA GENERATING PROGRAM

CROSS-REFERENCE TO RELATED APPLICATIONS

This application is based upon and claims the benefit of priority from the prior Japanese Patent Application 2009-242357, filed on Oct. 21, 2009, the entire content of which are incorporated herein by reference.

FIELD

The present disclosure relates to a punch data generating device that generates punch data for execution of a penetration forming operation by an embroiderable sewing machine to form penetrations on a workpiece sheet. The present disclosure also relates to a computer readable medium storing a punch data generating program.

BACKGROUND

Conventional multi-needle embroidery sewing machines are capable of executing embroidery sewing operations with multiple thread colors. A typical multi-needle embroidery sewing machine of such type is provided with a sewing mechanism and a controller that controls the sewing mechanism. The sewing mechanism is configured, for instance, by a needle-bar case containing six needle bars, a needle-bar selection mechanism, and a needle-bar drive mechanism. The needle-bar selection mechanism selects a given needle by transferring the needle-bar case in the left and right direction and the selected needle bar is connected to the needle-bar drive mechanism to be driven up and down. The sewing mechanism is further configured by a transfer mechanism that transfers an embroidery frame holding a workpiece cloth in the X and Y directions. The controller, on the other hand, receives input of pattern data that contains instructions on the amount of stroke-by-stroke movement of workpiece cloth/embroidery frame, and on timing for changing the thread color, etc. Based on the pattern data, the controller transfers the embroidery frame holding the workpiece cloth in the X and Y directions by the transfer mechanism while controlling other components of the sewing mechanism to form embroidery in multiple colors.

Some embroidery sewing machines come with a heat cutter provided with a heater for creating patches of images and characters. Such heat cutters are attached to the carriage of a drive mechanism of an embroidery frame. The heat cutter cuts through fabric and paper to cut out the patches.

The inventors have conceived to utilize the multi-needle embroidery sewing machine as a device for creating patterns on a sheet of workpiece such as paper. One exemplary configuration for creating the patterns with the multi-needle sewing machine may be as follows. Some of the plurality of needle bars is mounted with one or more punch needle(s) for forming penetrations such as small holes instead of a sewing needle (s).

Further, embroidery frame for holding the workpiece being attached to the transfer mechanism may be replaced by a holder providing a secure hold of the workpiece which is also attached to the transfer mechanism. Thus, a desired pattern made of a plurality of penetrations can be created on the surface of the workpiece cloth by moving the needle bar(s) having punch needle(s) attached to it up and down by the needle bar drive mechanism while transferring the holder holding the workpiece by the transfer mechanism.

After creating the pattern made of multiplicity of penetrations on workpiece such as paper with the above configured device, the user may desire to cut out the created pattern along the outline of the workpiece. In such case, it would be quite troublesome for the user to neatly cut out the pattern from the workpiece manually with scissors, etc. Thus, the aforementioned cutter may be attached to the sewing machine to cut out the workpiece in the desired shape. Another alternative may be to use a dedicated cutter known as a cutting plotter.

In either of the above alternative cases, a separate cutter or a cutter plotter need to be prepared as an attachment to the sewing machine, and thus, would lead to cost increase of the system. After the workpiece has been cut along the outline of the desired pattern, it would be further advantageous to allow the user to neatly detach the outline of the pattern from the workpiece without damaging or bending the outer edge of the outline.

SUMMARY

One object of the present disclosure is to provide a punch data generating device that generates punch data for forming penetrations on a sheet of workpiece with an embroiderable sewing machine and that allows cutting of the workpiece along the outline of a given pattern. Moreover, the generated punch data allows the user himself/herself to detach the outline of the generated pattern from the workpiece with greater ease. It is another object of the present disclosure to provide a computer readable medium storing a punch data generating program to render the above described features.

In one aspect of the present disclosure there is provided a punch data generating device that generates punch data for execution with an embroiderable sewing machine including a needle bar that is moved up and down and that allows attachment of a punch needle for forming a plurality of penetrations on a sheet of workpiece by piercing the workpiece in dot-by-dot strokes of the punch needle, a transfer mechanism that transfers the workpiece in two predetermined directions in coordination with an up and down movement of the punch needle to execute a penetration forming operation for forming the penetrations on the workpiece. The punch data generating device includes a cut data generator that generates cut data constituting the punch data, the cut data being configured to instruct sequential formation of the penetrations along an outline of a predetermined pattern to allow cutting of the outline, and an auxiliary cut data generator that generates auxiliary cut data constituting the punch data, the auxiliary cut data being configured to instruct sequential formation of the penetrations contacting the outline of the pattern to form a cut that facilitates detachment of the outline from the workpiece.

BRIEF DESCRIPTION OF THE DRAWINGS

Other objects, features and advantages of the present disclosure will become clear upon reviewing the following description of the illustrative aspects with reference to the accompanying drawings, in which.

FIG. 8A exemplifies a data configuration of line data prior to auxiliary cut data generating process;

FIG. 8B exemplifies a data configuration of line data after auxiliary cut data generating process;

DETAILED DESCRIPTION

Figure 2:
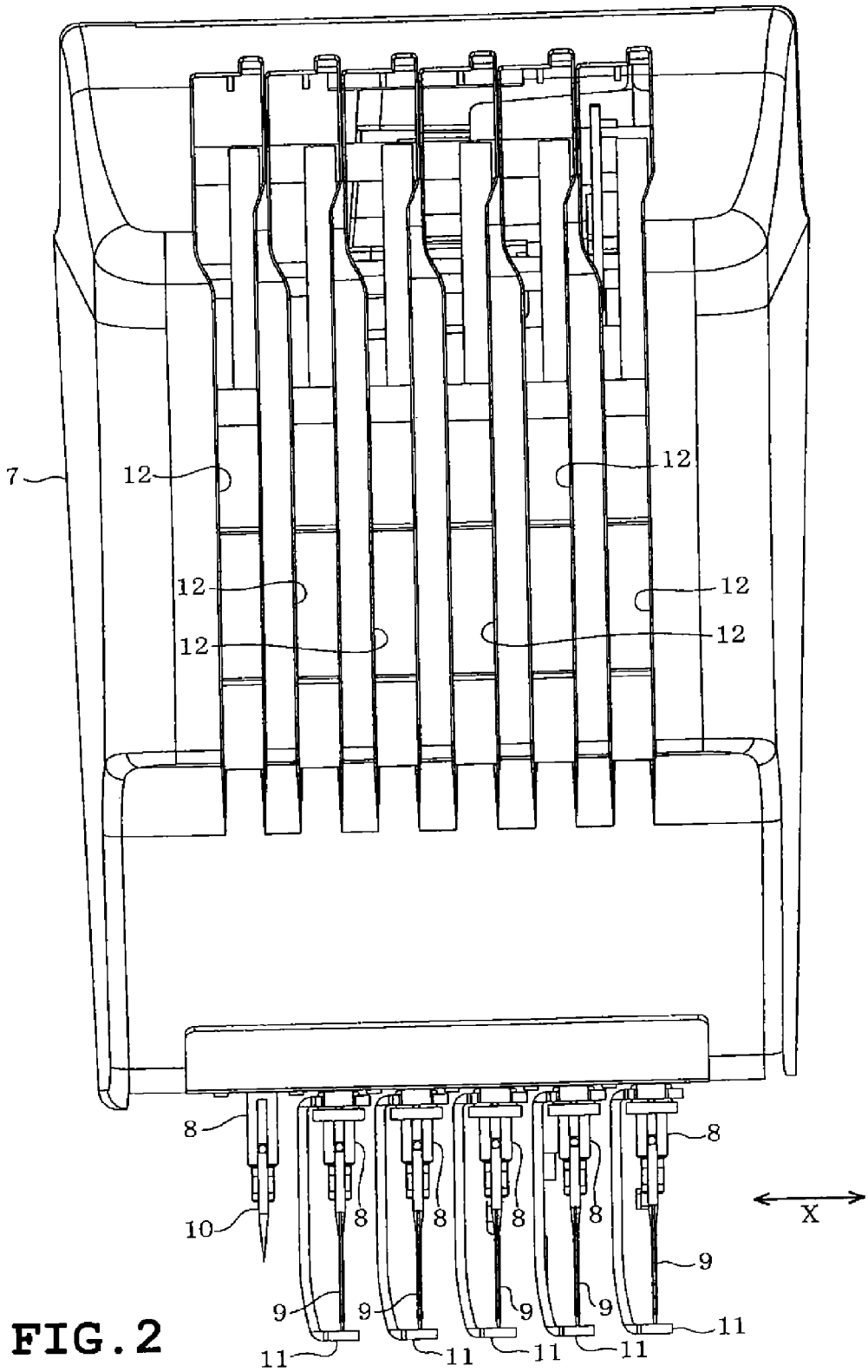
FIG. 2 is a front view of a needle bar case.
Figure 3:
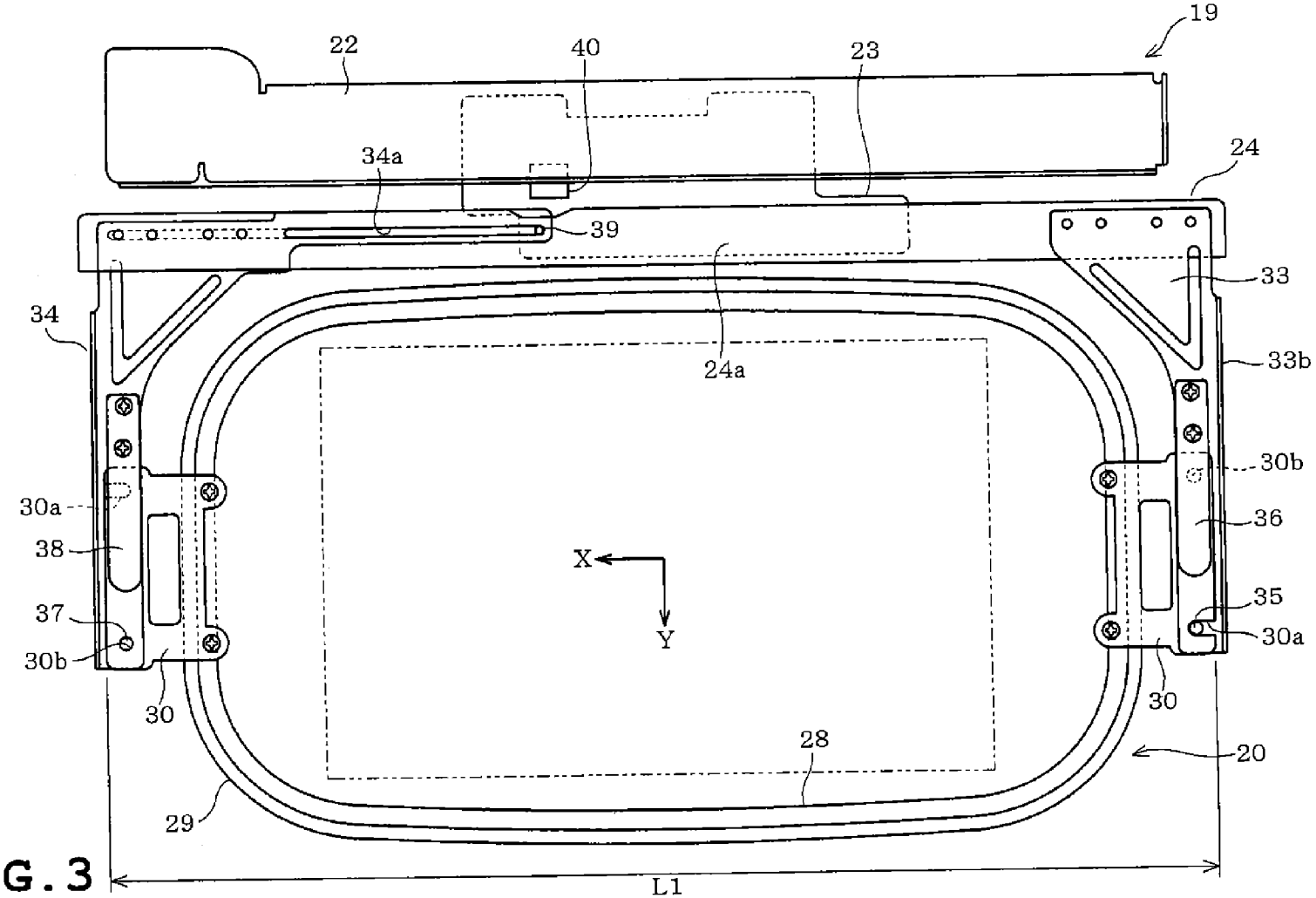
FIG. 3 is a plan view of a frame holder with an embroidery frame attached.

A description will be given hereinafter on a first exemplary embodiment of the present disclosure with reference to FIGS. 1 to 17. The first exemplary embodiment describes a case where a multi-needle embroidery sewing machine capable of forming embroideries includes the features of a punch data generating device. The multi-needle embroidery sewing machine may also be referred to as embroidery sewing machine or embroiderable sewing machine. First, a description will be given on the configuration of multi-needle embroidery sewing machine 1. In the description given hereinafter, the left and right direction relative to multi-needle embroidery sewing machine 1, is defined as the X direction whereas the front and rear direction relative to multi-needle embroidery sewing machine 1 is defined as the Y direction as indicated in FIGS. 1 to 3.

Figure 1:
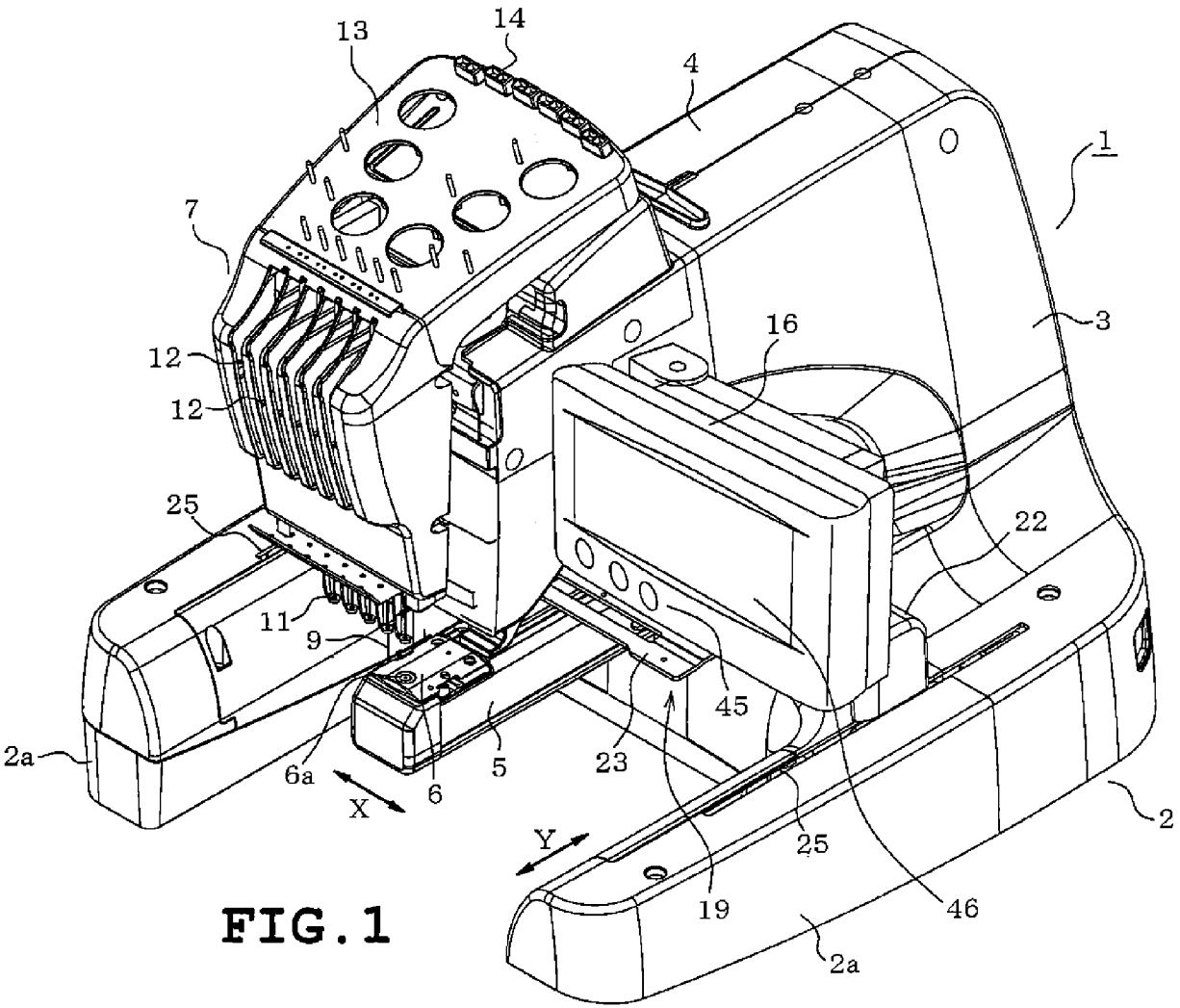
FIG. 1 is a general perspective view of a multi-needle embroidery sewing machine according to a first exemplary embodiment of the present disclosure.

Referring to FIG. 1, multi-needle embroidery sewing machine 1 is primarily configured by support base 2 placed on a placement base not shown, pillar 3 extending upward from the rear end of support base 2, and arm 4 extending forward from the upper end of pillar 3. Support base 2 is configured in U-shape in top view with left and right feet 2*a* extending forward to embrace a forward opening between them. Support base 2 is further provided integrally with cylinder bed 5 extending forward from its rearward mid portion. On the upper portion of the extremity of cylinder bed 5, needle plate 6 is provided that has needle holes 6*a* defined on it. Though not shown, cylinder bed 5 contains components such as a loop taker shuttle, a thread cut mechanism, and a picker.

Figure 6:
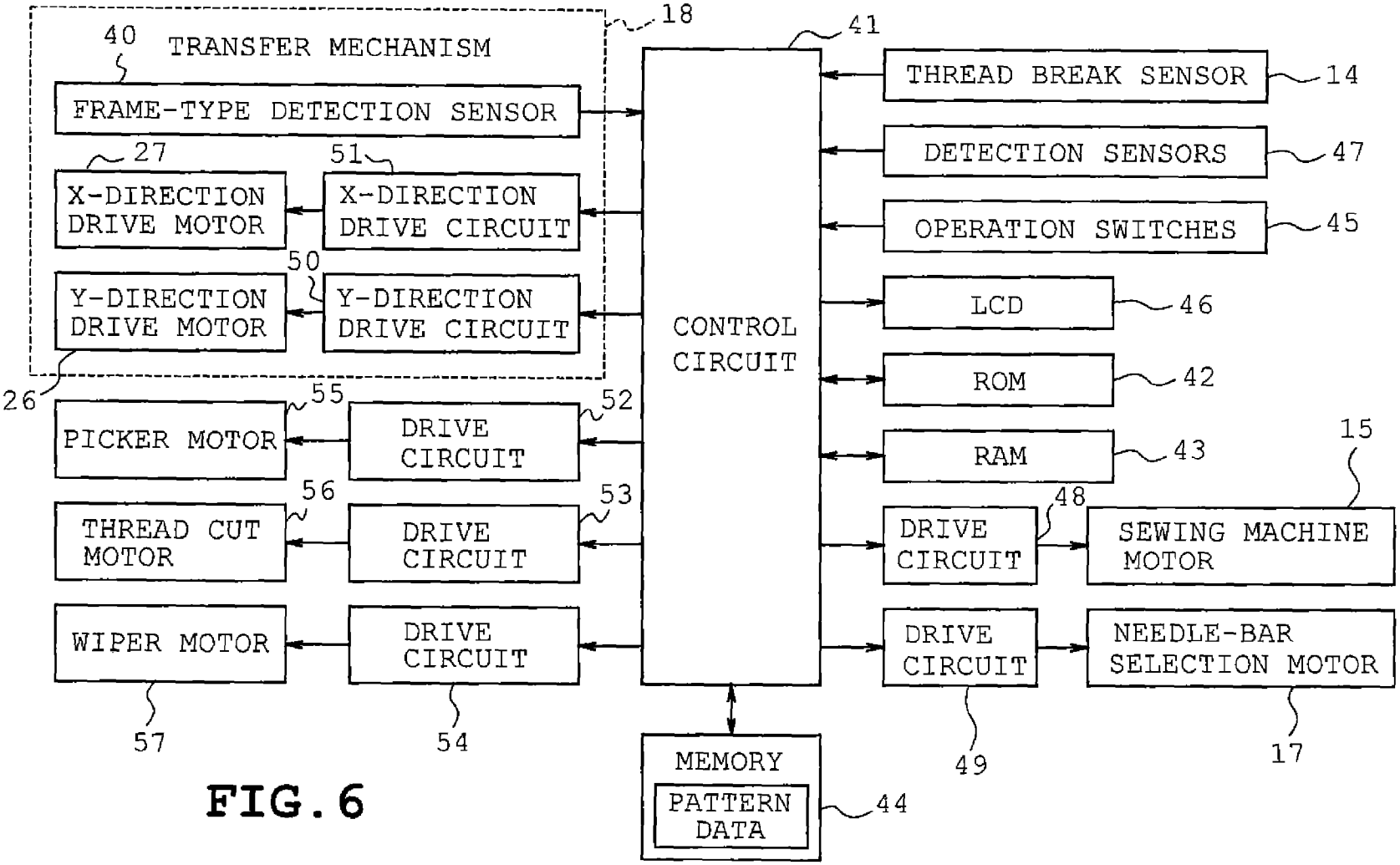
FIG. 6 is an overall block diagram of an electrical configuration of the multi-needle embroidery sewing machine.

On the right side of arm 4, control panel 16 is provided that is implemented with elements such as control switches 45 to allow the user to make various instructions, selections, and inputs and a liquid crystal display 46, simply represented as LCD 46 in FIG. 6, that displays various messages, etc. to be presented to the user. Control switches 45 include a plurality of mechanical switches not shown provided in the vicinity of LCD 46 and a touch panel implemented on the screen of LCD 46.

As later described, LCD 46 displays images of patterns and outlines based on punch data. Through control of the touch panel, the user is allowed to specify the location where the cut is to be formed based on the displayed images. Though not shown, at the rear side upper portion of arm 4, a thread supplier capable of accommodating multiple thread spools is provided, which is configured to hold six thread spools in the present exemplary embodiment.

As also shown in FIG. 2, on the extremity of arm 4, needle bar case 7 is provided which is movable in the left and right direction which also referred to as the X-direction. As can be seen in FIG. 2, needle bar case 7 is longitudinally thin, and comes in a shape of a rectangular box. Needle bar case 7 contains a plurality of needle bars 8, six, in the present exemplary embodiment, aligned in the left and right direction so as to be movable up and down. Each needle bar 8 is subject to consistent upward bias toward the uppermost position shown in FIG. 2 by a coil spring not shown.

The lower ends of these needle bars 8 extend downward out of needle case 7 and sewing needle 9 used for embroidery sewing is detachably/interchangeably attached to them. The six needle bars 8 are identified by needle bar numbers 1 to 6, in this case, in ascending order from right to left. In the present exemplary embodiment, the leftmost specific needle bar 8 among the six needle bars 8, that is, the no. 6 needle bar 8, has punch needle 10 detachably attached to it instead of sewing needle 9. Punch needle 10 will be later described in detail.

Referring to FIG. 2, at the lower potion of needle bar 8, presser foot 11 for use in embroidery sewing is provided that is moved up and down in synchronism with needle bar 8. Presser foot 11 for the no. 6 needle bar 8 is removed when punch needle 10 is attached instead of sewing needle 9. Though not shown in detail, above needle bar case 7, six thread take-ups are provided, each dedicated to each of the six needle bars 8. The tip of each thread-take up protrudes forward through six vertical slits 12 defined on the front face of needle bar case 7 and is driven up and down in synchronism with the up and down movement of needle bar 8. Though also not shown, behind needle bar 8 which is placed in a position to be driven up and down by a later described needle-bar vertically moving mechanism, a wiper is provided.

Referring to FIG. 1, needle bar case 7 has upper cover 13 provided integrally with it that extends obliquely reward from its upper end. Though only mounting holes are shown, upper cover 13 is provided with six thread tension regulators along with six thread break sensors 14 provided on its upper end.

The needle thread for embroidery sewing is drawn from the thread spools set to the thread supplier and is sequentially engaged with a threading route including components such as thread break sensor 14, thread tension regulators, and thread take-ups. When needle thread is finally passed through eye not shown of sewing needle 9, multi-needle embroidery sewing machine 1 is ready for embroidery sewing. By supplying different colors of needle threads to each of the six or five sewing needles 9, embroidery sewing operation with multiple needle colors can be executed consecutively by automatic switching of thread colors.

Though not shown in detail, pillar 3 is provided with sewing machine motor 15 only shown in FIG. 6. As known in the art, arm 4 is provided with components such as a main shaft driven by sewing machine motor 15, a needle-bar vertically drive mechanism that vertically moves needle bars 8 etc., by the rotation of the main shaft, and a needle-bar selector/driver mechanism that selects needle bar 8 by moving needle bar case 7 in the X-direction. The rotation of the main shaft also causes the loop taker shuttle to be driven in synchronism with the up and down movement of needle bar 8.

Needle-bar vertically moving mechanism is provided with a vertically moving element that is selectively engaged with needle bar clamp not shown provided at needle bar 8. The needle-bar selector/driver mechanism is driven by needle-bar selection motor 17 only shown in FIG. 6 to move needle bar case 7 in the X-direction to select either of needle bars 8, located immediately above needle hole 6*a*, to be engaged with the vertically moving element. Needle-bar selector/driver mechanism configured as described above selects one of the needle bars 8 and the selected needle bar 8 and the thread take-up corresponding to the selected needled bar 8 is moved up and down by the needle-bar vertically moving mechanism.

Then as shown in FIG. 1, in the front side of pillar 3 above support base 2, carriage 19 of transfer mechanism 18 shown in FIG. 6 is provided slightly above cylinder bed 5. Carriage 19 allows detachable attachment of embroidery frame 20 shown in FIG. 3 for holding a workpiece cloth to be embroidered or holder 21 shown in FIGS. 4A, 4B, and 5A for holding a sheet of workpiece W made of paper and plastic etc., on which a later described penetration forming operation is performed. In the present exemplary embodiment, embroidery frame 20 for holding the workpiece cloth and coming in various shapes and sizes are provided as accessories to multi-needle embroidery sewing machine 1.

As shown in FIGS. 1 and 3, carriage 19 is provided with Y-direction carriage 22, X-direction carriage 23 provided at Y-direction carriage 22, and frame holder 24 only shown in FIG. 3 attached to X-direction carriage 23. Though not shown in detail, transfer mechanism 18 includes a Y-direction drive mechanism provided within support base 2. Y-direction drive mechanism moves Y-direction carriage 22 freely in the Y direction, that is, the front and rear direction. Transfer mechanism 18 also includes an X-direction drive mechanism provided within Y-direction carriage 22. The X-direction drive mechanism transfers X-direction carriage 23 and frame holder 24 in the X direction, that is, the left and right direction. Embroidery frame 20 or holder 21 is held by frame holder 24 and is moved freely in the two predetermined directions, in this case, the X and Y directions by transfer mechanism 18.

To elaborate, Y-direction carriage 22 comes in a shape of an elongate, narrow box which extends in the X direction or the left and right direction over feet 2*a* of support base 2. As can be seen in FIG. 1, on the upper surface of left and right feet 2*a* of support base 2, guide groove 25 is defined that runs in the Y direction or the front and rear direction. Though not shown, the Y-direction mechanism is provided with a couple of transfer elements that vertically penetrates these guide grooves 25 to allow Y direction or front and rear movement along guide grooves 25. Both left and right ends of I-direction carriage 22 is connected to the upper end of the couple of transfer elements respectively.

The Y-direction drive mechanism is configured by Y-direction drive motor 26 shown in FIG. 6 comprising a step motor, and a linear transfer mechanism including components such as a timing pulley and timing belt, etc. The linear transfer mechanism driven by Y-direction drive motor 26 moves the transfer elements to allow Y-direction carriage 22 to be moved in the Y direction or the front and rear direction.

Referring to FIGS. 1 and 3, a portion of X-direction carriage 23 protrudes forward from the lower front side of Y-direction carriage 22. X-direction carriage 23 comes in the form of a laterally wide plate and is supported slidably in the X-direction or the left and right direction by Y-direction carriage 22. The X-direction drive mechanism provided within Y-direction carriage 22 is configured by X-direction drive motor 27 shown in FIG. 6 comprising a step motor, and a linear transfer mechanism including a timing pulley and timing belt, etc. X-direction carriage 23 is moved in the X direction or the left and right direction by the above described configuration.

Next, a description will be given on frame holder 24 attached to X-direction carriage 23, and embroidery frame 20 and holder 21 serving as a holder being detachably attached to frame holder 24. First, a description will be given on embroidery frame 20 with reference to FIG. 3. Embroidery frame 20 comprises inner frame 28 generally formed as a rectangular frame with rounded corners, outer frame 29 fitted detachably on the outer periphery of inner frame 28, and a pair of connecting portions 30 mounted on both left and right ends of inner frame 28. Though not shown, the workpiece cloth is clamped between inner frame 28 and outer frame 29 to hold the workpiece cloth in a tense, stretched state within inner frame 28.

The left and right pair of connecting portions 30 is provided on embroidery frame 20 so as to have 180-degrees rotational symmetry in plan view. Connecting portions 30 have engagement grooves 30*a* and engagement holes 30*b* for attachment to frame holder 24. Though not shown, different types of embroidery frame 20 are provided that come in different shapes and sizes having varying embroidery areas and are selected interchangeably depending on the size of the workpiece cloth and the embroidery. The width in the left and right direction, that is, the measurement between the outer edges of the connecting portions 30 represented as L1 in FIG. 3, is configured to vary depending upon the type of embroidery frame 20. The variance in width L1 allows the later described detector to detect the type of embroidery frame 20 and whether or not holder 21 has been attached instead of embroidery frame 20. FIG. 3 shows embroidery frame 20 having the greatest width L1.

Figure 4A:
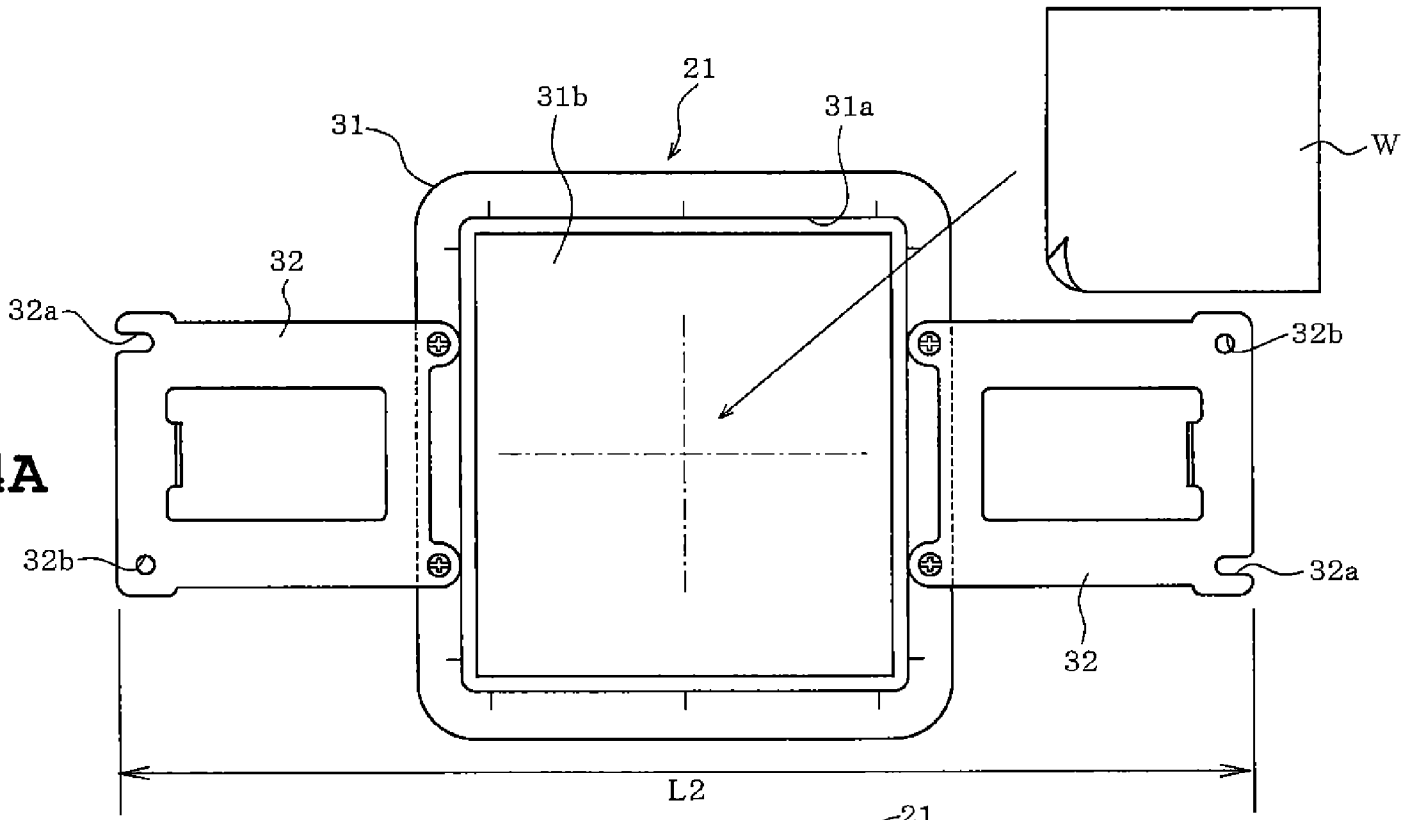
FIG. 4A is a plan view of a holder.
Figure 4B:
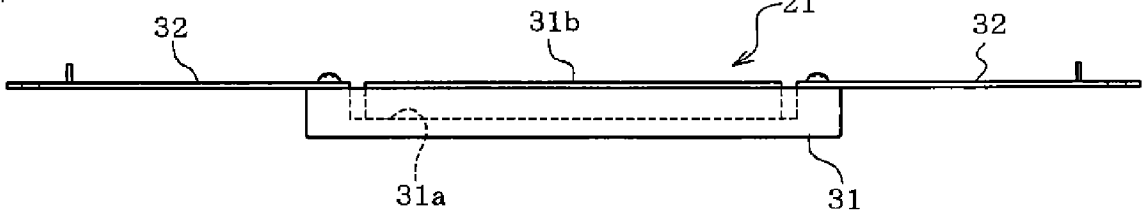
FIG. 4B is a front view of the holder.
Figures 5A, 5B:
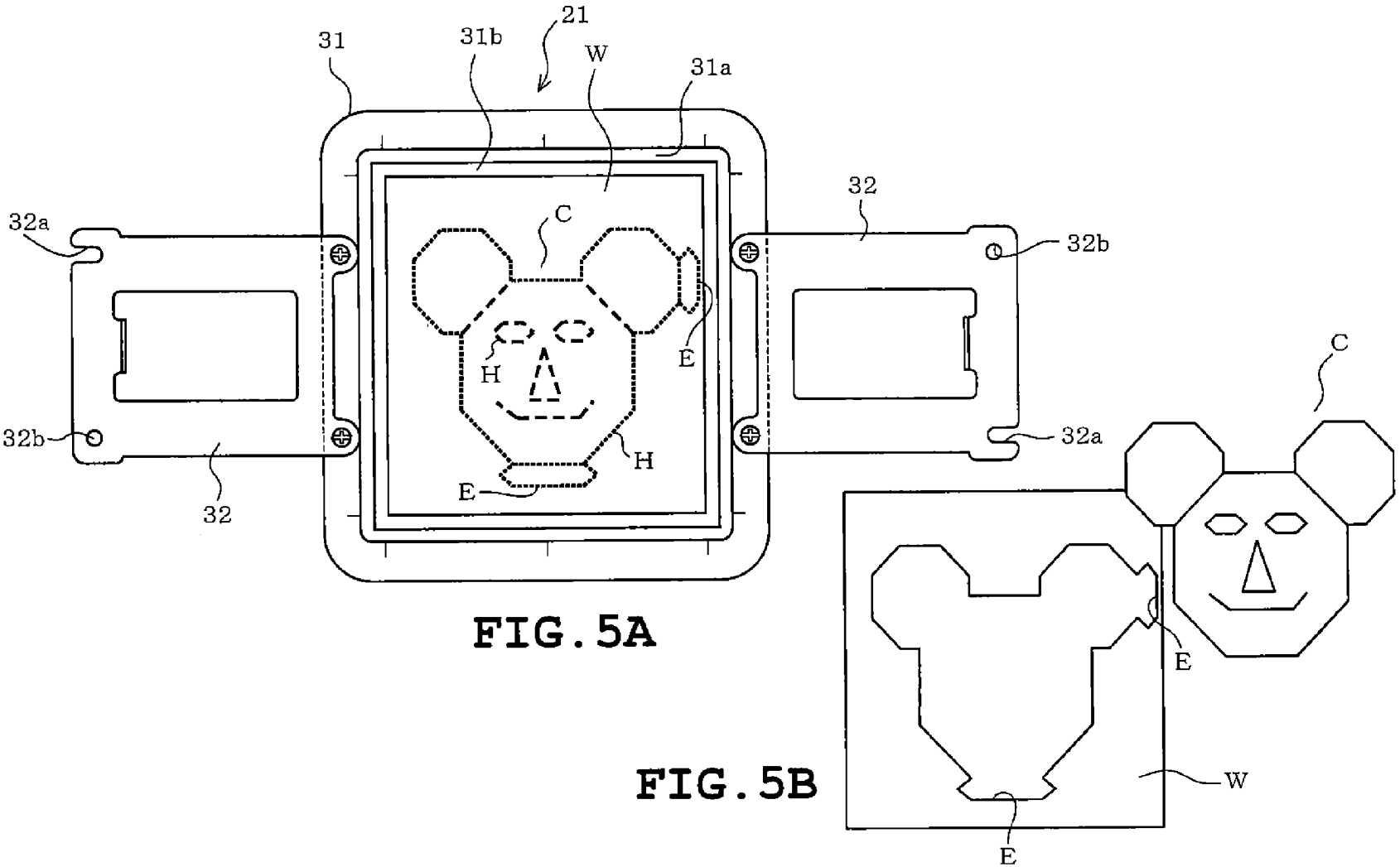
FIG. 5A is a plan view of a workpiece with penetrations formed on it.
FIG. 5B is a plan view showing the outline detached from the workpiece.

Next, a description will be given on holder 21. As shown in FIGS. 4A, 4B and 5A, holder 21 is provided with holder section 31 shaped as a rectangular plate with rounded corners and a pair of connecting portions 32 mounted on left and right ends of holder section 31. On the face of holder section 31 exclusive of its peripheral frame section, an enclosed bottom holder recess 31*a* is defined in a rectangular shape which contains elastic element 31*b*. Elastic element 31*b* is formed as a thin rectangular plate made of material such as foam resin or foam rubber. A sheet of workpiece W prepared in a rectangular shape corresponding to holder recess 31*a* is placed on the upper surface of elastic element 31*b* and is secured by fastening elements not shown such as a double-stick tape.

The left and right pair of connecting portions 32 is also disposed in 180-degrees rotational symmetry in plan view. Connecting portions 32 have engagement grooves 32*a* and engagement holes 32*b* for attachment to frame holder 24. The width in the left and right direction of holder 21, that is, the measurement between the outer edges of the connecting portions 32 represented as L2 in FIG. 4A, is configured to vary from width L1 of any given type of embroidery frame 20. Different types of holder 21 may also be provided depending on the shapes and sizes etc., of workpiece W as was the case of embroidery frame 20.

Frame holder 24 to which the above described embroidery frame 20 and holder 21 are attached/connected is configured as described below. Referring to FIG. 3, frame holder 24 is mounted unremovably on the upper surface of X-direction carriage 23. Frame holder 24 is provided with a stationary arm 33 and movable arm 34 mounted relocatably on stationary arm 33. Movable arm 34 is relocated in the left and right direction by the user depending upon the type, that is, width L1 or L2 of embroidery frame 20 or holder 21, whichever is attached.

Stationary arm 33 is placed over the right side upper surface of main section 24 of frame holder 24. Frame holder 24 is formed as an X-directionally elongate plate. Stationary arm 33 is provided with right arm 33*b* that is bent in a substantially right angle to extend forward. Provided on the upper surface extremity of right arm 33*b* are engagement pin 35 and leaf spring 36 for clamping connecting portions 30 and 32 provided rearward relative to engagement pin 35. Engagement pin 35 engages with engagement groove 30*a* of connecting portion 30 of embroidery frame 20 or engagement groove 32*a* of connecting portion 32 of holder 21.

Movable arm 34 is symmetrical in the left and right direction with right arm 33*b*. The base end or the rear end of movable arm 34 is mounted on main section 24*a* of frame holder 24 so as to be placed over the left side upper surface of main section 24*a*. Provided on the upper surface extremity of movable arm 34 are engagement pin 37 and leaf spring 38 for clamping connecting portions 30 and 32 provided rearward relative to engagement pin 37. Engagement pin 37 engages with engagement hole 30*b* of connecting portion 30 of embroidery frame 20 or engagement hole 32*b* of connecting portion 32 of holder 21.

On the base end or the rear end of movable arm 34, guide groove 34*a* is provided that extends in the left and right direction. Guide groove 34*a* allows engagement of guide pin 39 provided on the upper surface of main section 24*a* of frame holder 24. Thus, movable arm 34 is allowed to slide in the left and right direction relative to main section 24*a* of frame holder 24. Though not shown, main section 33*a* of stationary arm 33 is provided with a lock mechanism that allows movable arm 34 to be selectively locked at different predetermined positions. The position of movable arm 34 is relocated in the left and right direction through user operation of the lock mechanism.

The above described configuration allows the user to lock movable arm 34 at a position suitable for the type, in other words, the width such as L1 and L2 of embroidery frame 20 or holder 21 to be attached and proceed to attachment of embroidery frame 20 or holder 21 to frame holder 24. As exemplified in FIG. 3, in attaching embroidery frame 20 to frame holder 24, first, connecting portions 30 at the left and right ends of embroidery frame 20 are each inserted in the rearward direction from the front side of leaf spring 38 of movable arm 34 and leaf spring 36 of right arm 33*b*, respectively. Then, engagement pin 37 of movable arm 34 is engaged with engagement hole 30*b* of connecting portion 30 and engagement pin 35 of right arm 33*b* is engaged with engagement groove 30*a* of connecting portion 30. Thus, embroidery frame 20 is held by frame holder 24 and transferred in the X and Y directions by transfer mechanism 18. Holder 21 is attached to frame holder 24 in the same manner.

As shown in FIGS. 3 and 6, X-direction carriage 23 is provided with frame-type sensor 40 for detecting the type of embroidery frame 20 or holder 21 attached through detection of the position of movable arm 34. Though not shown, frame-type sensor 40 comprises a rotary potentiometer, for example, and is provided with a detection tip that is placed in contact with detection subject comprising a sloped surface, for example, provided on movable arm 34. The relocation of movable arm 34 in the left and right direction alters the height of the sloped surface placed in contact with the detection tip. This causes change in the rotational angle of the detection tip to cause variation in the output signals of frame-type detection sensor 40. As shown in FIG. 6, the output signal of frame-type detection sensor 40 is inputted to a later described control circuit 41 whereafter the type of embroidery frame 20 or holder 21 is determined by control circuit 41 based on the difference of the incoming output signal from frame-type detection sensor 40.

In the present exemplary embodiment, multi-needle embroidery sewing machine 1 is capable of executing a normal embroidery sewing operation on the workpiece cloth using six colors of embroidery thread as well as executing a penetration forming operation on workpiece W. Penetration forming operation is executed by impinging, in this case, piercing punch needle 10 dot by dot on the surface of workpiece W while transferring holder 21 in the X and Y directions by transfer mechanism 18 to form a plurality of penetrations H which is typically small holes on workpiece W as shown in FIG. 7. By forming penetrations on workpiece W, various patterns can be created on workpiece W. Apart from such pattern formation, forming of penetrations may be utilized, for instance, to cut workpiece W into a predetermined shape by forming penetrations H sequentially or consecutively at least along the outline of the created pattern.

In executing a penetration forming operation, sewing needle 9 provided on the leftmost, that is, the no. 6 needle bar 8 of the six needle bars 8 is replaced by punch needle 10 as shown in FIG. 2. Punch needle 10 has a sharpened tip suitable for forming penetrations H on workpiece W and is shorter in length as compared to sewing needle 9. The length of punch needle 10 is so dimensioned such that, when needle bar 8 is lowered to the lowermost position, the tip of punch needle 10 pierces through workpiece W held by holder 21 at the lowermost point of reciprocation of needle bar 8 but stops short of penetrating through elastic element 31*b* provided at holder 21.

As can be seen in FIG. 7, diameter $\phi$B of a single penetration H formed by the penetration forming operation of punch needle 10 is specified, for instance, at 0.1 mm. Further, as shown in FIG. 2, presser foot 11 is removed from needle bar 8 having punch needle 10 attached to it. As one may readily assume, in case punch needle 10 is attached to the no. 6 needle bar 8, embroidery sewing operation is executed with the remaining five needle bars 8 no. 1 to 5 using embroidery threads of five colors or less.

FIG. 6 schematically indicates the electrical configuration of multi-needle embroidery sewing machine 1 according to the present exemplary embodiment with a primary focus on control circuit 41. Control circuit 41 is primarily configured by a computer, in other words, a CPU establishing connection with ROM 42, RAM 43, and external memory 44. ROM 42 stores items such as embroidery sewing control program, penetration forming control program, punch data generating program, and various types of control data. External memory 44 stores items such as various types of embroidery pattern data, line data, and punch data.

Control circuit 41 receives input of operation signals produced from various operation switches 45 of the operation panel and is also responsible for controlling the display of LCD 46. The user, while viewing LCD 46, operates various operation switches 45 to select the sewing mode such as the embroidery sewing mode, penetration forming mode, and punch data generating mode and to select the desired embroidery pattern and draw pattern which is generated by formation of penetrations.

Control circuit 41 also receives input of detection signals such as detection signals from thread break sensor 14, frame-type detection sensor 40 provided at transfer mechanism 18, and other detection sensors 47 including main shaft rotational angle sensor for detecting the rational phase of the main shaft and consequently the elevation of needle bar 8. Control circuit 41 controls the drive of sewing machine motor 15 through drive circuit 48 and needle-bar selection motor 17 through drive circuit 49.

Control circuit 41 further controls the drive of Y-direction drive motor 26 for transfer mechanism 18 through drive circuit 50, and X-direction drive motor 27 through drive circuit 51 to drive frame holder 24 and consequently embroidery frame 20 and holder 21. Further, control circuit 41 executes thread cut operation by controlling picker motor 55 serving as a drive source for a picker not shown, thread cut motor 56 serving as a drive source for a thread cut mechanism not shown, and wiper motor 57 serving as drive source for a wiper not shown through drive circuits 52, 53, and 54, respectively.

Control circuit 41 executes the embroidery sewing control program which automatically executes the embroidery sewing operation on the workpiece cloth held by embroidery frame 20 under the embroidery sewing mode. When executing the embroidery sewing operation, the user is to select pattern data from a collection of embroidery pattern data stored in external memory 44. Embroidery sewing operation is executed by controlling components such as sewing machine motor 15, needle-bar selection motor 17, Y-direction drive motor 26 and X-direction drive motor 27 of transfer mechanism 18 based on the selected pattern data.

As well known, embroidery pattern data contains stroke-by-stroke needle drop point, that is, stroke-by-stroke data or transfer data indicating the amount of X direction or Y direction movement of embroidery frame 20. Further, pattern data contains data such as color change data that instructs switching of embroidery thread color, that is, switching of needle bar 8 to be driven; thread cut data that instructs the thread cut operation; and sew end data.

In the present exemplary embodiment, control circuit 41 automatically executes penetration forming operation on the surface of workpiece W held by holder 21 with punch needle 10 through software configuration, that is, the execution of penetration forming control program under the penetration forming mode. In the penetration forming operation, control circuit 41 controls sewing machine motor 15, needle-bar selection motor 17, and Y direction motor 26 and X direction motor 27 of transfer mechanism 18 based on the punch data.

Penetration forming operation is executed by selecting the no. 6 needle bar 8 and repeatedly moving the selected needle bar 8, that is, punch needle 10 up and down while moving punch workpiece W to the next penetration forming position when needle bar 8 is elevated. Punch data is primarily configured by a collection of stroke-by-stroke penetration forming position or the punching point of punch needle 10, in other words, stroke-by-stroke movement amount in the X and Y directions of holder 21, that is, punch workpiece W.

In the present exemplary embodiment, as later described through the flowchart, control circuit 41 executes penetration forming operation provided that attachment of holder 21 to frame holder 24 has been detected. This means that the activation of sewing machine motor 15 is not permitted even if execution of penetration forming operation is instructed by the user when attachment of holder 21 has not been detected or when attachment of embroidery frame 20 has been detected.

Further, in the present exemplary embodiment, as will also be later described through the flowcharts, control circuit 41 implements the feature of the punch data generating device, which generates punch data for execution of penetration forming operation through execution of punch data generating program. The punch data contains three types of data, namely, draw data, cut data, and auxiliary cut data.

The draw data is used for drawing one or more predetermined pattern(s) on workpiece W through formation of a plurality of penetrations H. The cut data is used for cutting along the outline of the one or more predetermined pattern(s) created on the workpiece W by sequentially forming penetrations H along the outline. As can be seen in FIGS. 5A, 5B, 12A, and 12B, the auxiliary cut data is used for forming cut E which helps the user when detaching the outline of the pattern from workpiece W. Cut E is formed on workpiece W by forming a plurality of penetrations H on the adjacent outer side of a given portion of the pattern outline.

Among such punch data, the formation of the draw data and the cut data begins by extracting images of lines constituting the pattern from the pattern image data pre-stored in external memory 44. Then, based on the extracted line data, a plurality of penetrations, in other words, punch dots are plotted along each if the extracted lines to determine the locations where the penetrations are to be formed. In the present exemplary embodiment, control circuit 41 is configured to form penetration H at different pitches depending on whether the punch data specified is the draw data or the cut data when generating the punch data through execution of the punch data generating program. To elaborate, the location of the punch dots are specified so that penetration H is formed at a smaller pitch when formed based on the cut data as compared to when formed based on the draw data.

Figure 7A:
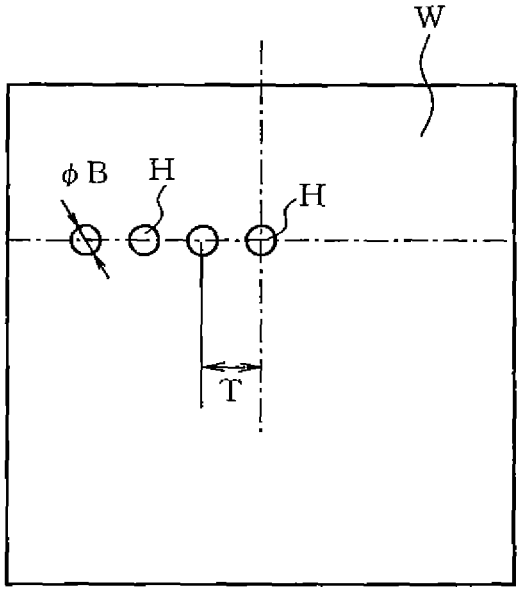
FIG. 7A is a plan view of the workpiece with penetrations formed at a pitch being relatively greater in width.
Figure 7B:
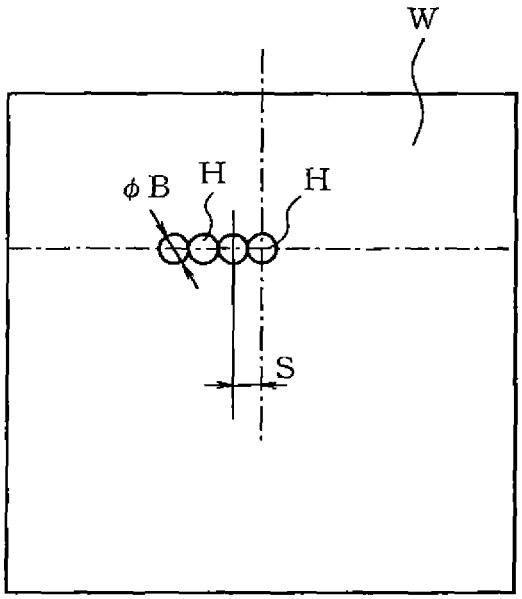
FIG. 7B is a plan view of the workpiece with penetrations formed at a pitch being relatively less in width.

For example, when generating the draw data (punch data type=draw data), hole-by-hole pitch T or simply pitch T at which the punch dots are specified on the extracted line is set at a value greater than diameter ϕB of penetration H such as 0.2 mm as shown in FIG. 7A. When generating the cut data (punch data type=cut data), pitch S at which the punch dots are specified on the extracted line is set at a value equal to or less than diameter ϕB of penetration H such as 0.1 mm as shown in FIG. 7B. As described above, control circuit 41 includes the features for both draw data generation and cut data generation, and thus, the user is given an option to select whether to generate each of the extracted lines as the draw data or the cut data. Alternatively, control circuit 41 may be configured to automatically select generation of the cut data when the extracted line constitutes an outline and otherwise proceed to generation of the draw data.

Further, control circuit 41 is configured so that, when generating or editing the punch data as described above, the image of penetrations H being formed on workpiece W is shown on an edit screen presented on LCD 46. At this instance, control circuit 41 employs different representations for pattern images based on the draw data and for outline images based on the cut data. To elaborate, in the present exemplary embodiment, the pattern images based on the draw data are represented as a collection of broken lines having a length of certain extent, whereas the outline images based on the cut data are represented as a collection of small dots as exemplified in FIG. 10.

As shown in FIGS. 5A, 5B, 12A, and 12B, the present exemplary embodiment further allows formation of auxiliary cut data as one type of punch data. The auxiliary cut data allows formation of auxiliary cut E that extends on the outer side of the outline of a pattern such that auxiliary cut E and a portion of the outline form a hexagonal through hole that elongates in the direction in which the outline extends. The through hole is sized at approximately 15 mm in width to allow insertion of the user's finger. The generation of auxiliary cut data is carried out by specifying the location of consecutive penetrations or punch dots residing along auxiliary cut E. For instance, pitch S at which the punch dots are formed may be specified so as to be equal to or less than the diameter $\phi$ of penetration B such as 0.1 mm.

Figure 10:
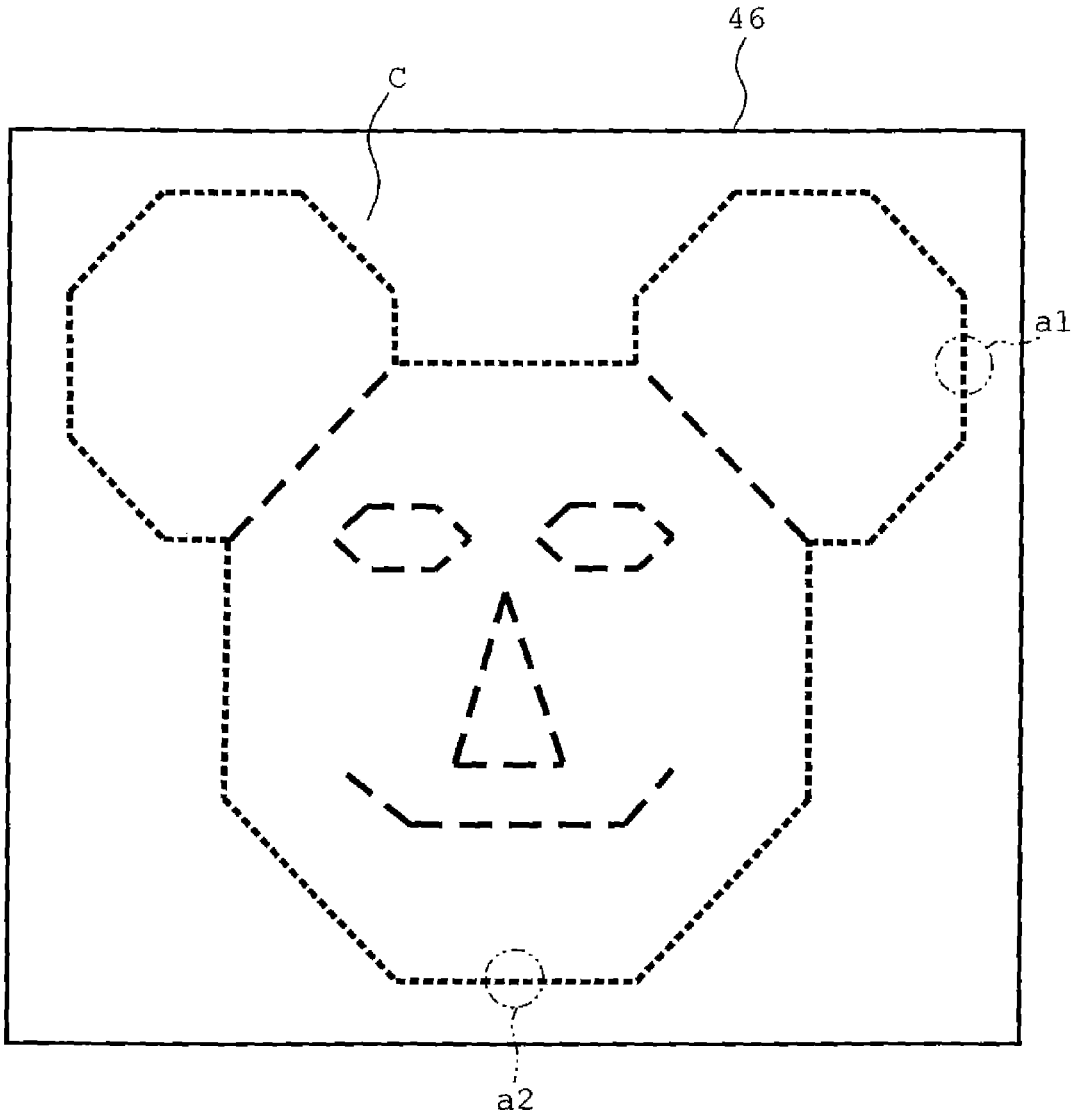
FIG. 10 is an example of how a liquid crystal display shows lines constituting a given character design.

Further according to the present exemplary embodiment, generation of the auxiliary cut data begins with presenting the image of the pattern on LCD 46 as shown in FIG. 10. Then, based on the presented image, the user is to specify the location in which cut E is to be formed. Responsively, controller 41 finds a segment, running between a couple of line elements of a line constituting the outline, which is nearest to the location specified by the user. Then, controller 41 specifies cut E to form a through hole so that the found segment constitutes one of the sides of the through hole to thereby form the auxiliary cut data. The user may be allowed to specify more than one location to form more than one cut E. Alternatively, the user may not be required to specify the location of cut E but instead, the location of cut E may be specified automatically to form a couple of cuts E on the left and right sides of the outline, for instance, by default.

Next, the operation of the above described configuration will be described with reference to FIGS. 8A to 17. As typically shown in FIG. 9, a description will be given through an example of generating the punch data for character C showing a face of a mouse with big ears. An example of the draw data generation will be discussed through drawing of patterns within the bounds or the outline of character C on workpiece W, such as drawing the parts of the face such as the eyes, nose, mouth and the boundaries between the face and the ears. An example of the cut data generation will be discussed through cutting of outlines of the patterns. Lastly, as shown in FIGS. 5A and 5B, an example of the auxiliary cut data generation will be discussed through the user's specification of 2 locations on workpiece W, one on the right side portion of the right ear outline of character C and one on the lower side of the face, based upon which cuts E and consequently through holes are formed.

Figure 9:
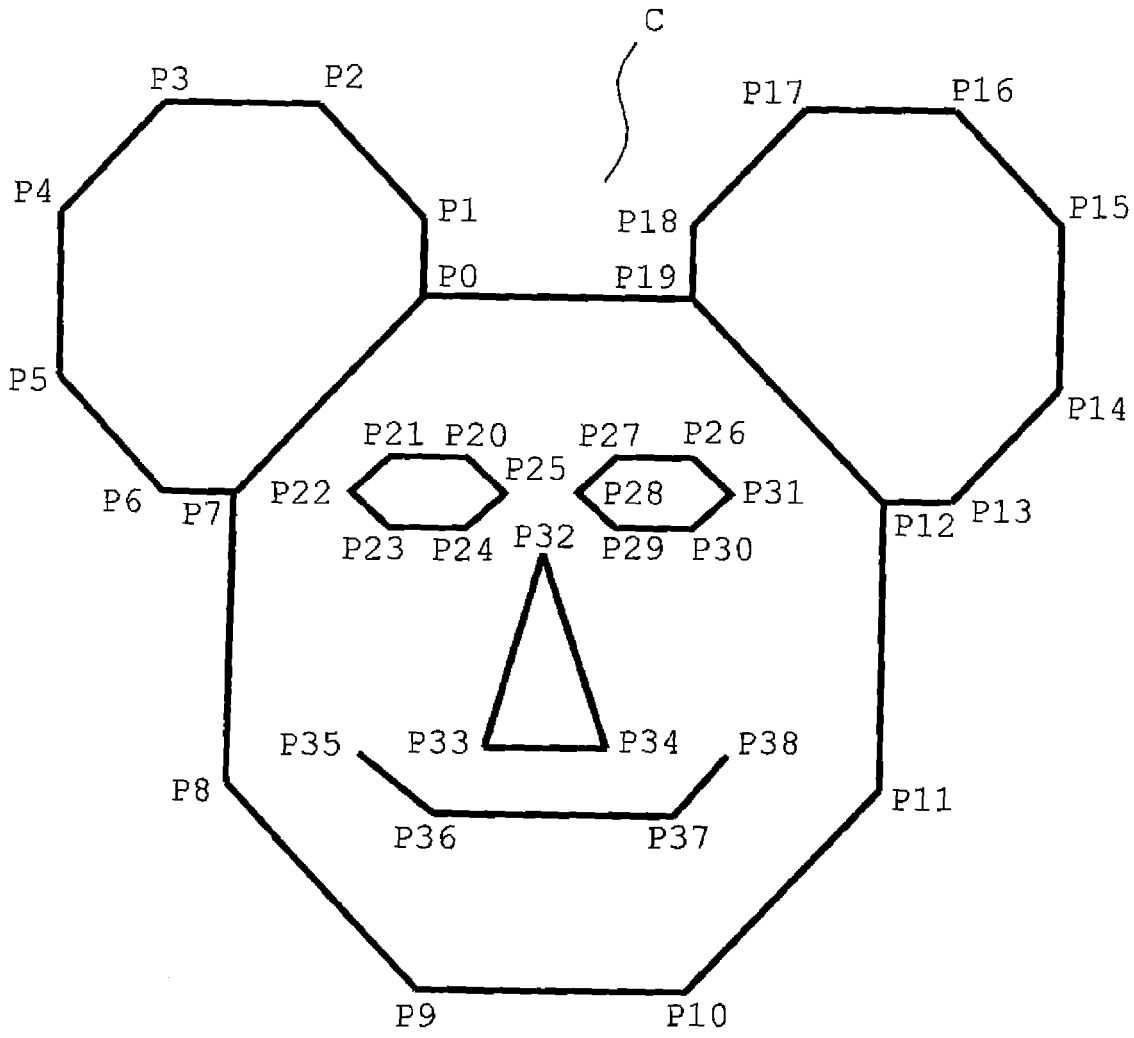
FIG. 9 exemplifies a character being the subject of punch data generation.

FIGS. 8A and 9 indicate the configuration of line data for character C that is stored in the data memory. The line data contains parameters such as the line number of each line; the punch type of each line, that is, whether it constitutes the cut data or the draw data; and collection of position coordinates representing the line elements of each extracted line. The line elements are dots coming at the two ends of a segment within a chain of segments obtained by approximating the extracted line.

For instance, referring to FIG. 9, the line segments shaping the left ear of character C, that is, the line segments that provide the outline of the left ear portion of the entire outline hold a line parameter of: line number=1; punch type=cut; and line elements=P0, P1, P2, P3, P4, P5, P6, and P7. To give another example, the line segment constituting the boundary between the left ear and the face of character C hold a line parameter of: line number=2; punch type=draw; and line elements=P0 and P7. When executing the penetration forming operation, pattern drawing based on the draw data is prior in sequence to outline cutting based on the cut data, whereafter formation of cut E based on auxiliary cut data is executed. In each of the draw data, the cut data, and the auxiliary cut data, the lines are processed in the ascending order of their line numbers.

As described above, control circuit 41, when in the punch data generating mode, extracts the lines, that is, the images of lines constituting the pattern from image data of patterns stored in external memory 44 or ROM 42, based on, for instance, user selection. Then, based on the line data, the punch data generation process is executed to locate a plurality of penetrations, in other words, punch dots along the extracted lines to generate the draw data and the cut data. Further, auxiliary cut data is generated based on the spot specified by the user. The flowcharts shown in FIGS. 13 to 17 indicate the process flow of punch data generation process executed by control circuit 41.

Figure 13:
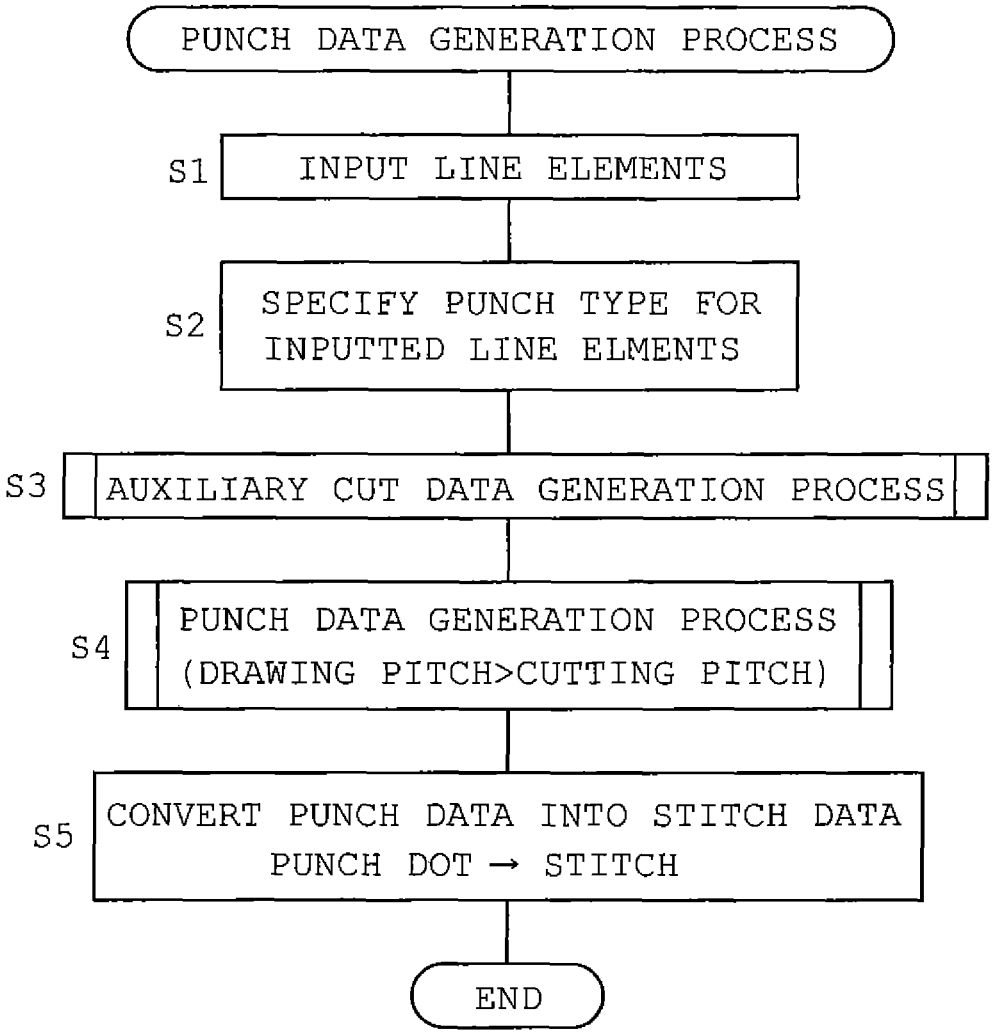
FIG. 13 is a flowchart showing the process flow of the main routine of a punch data generating process executed by a control circuit.
Figure 14:
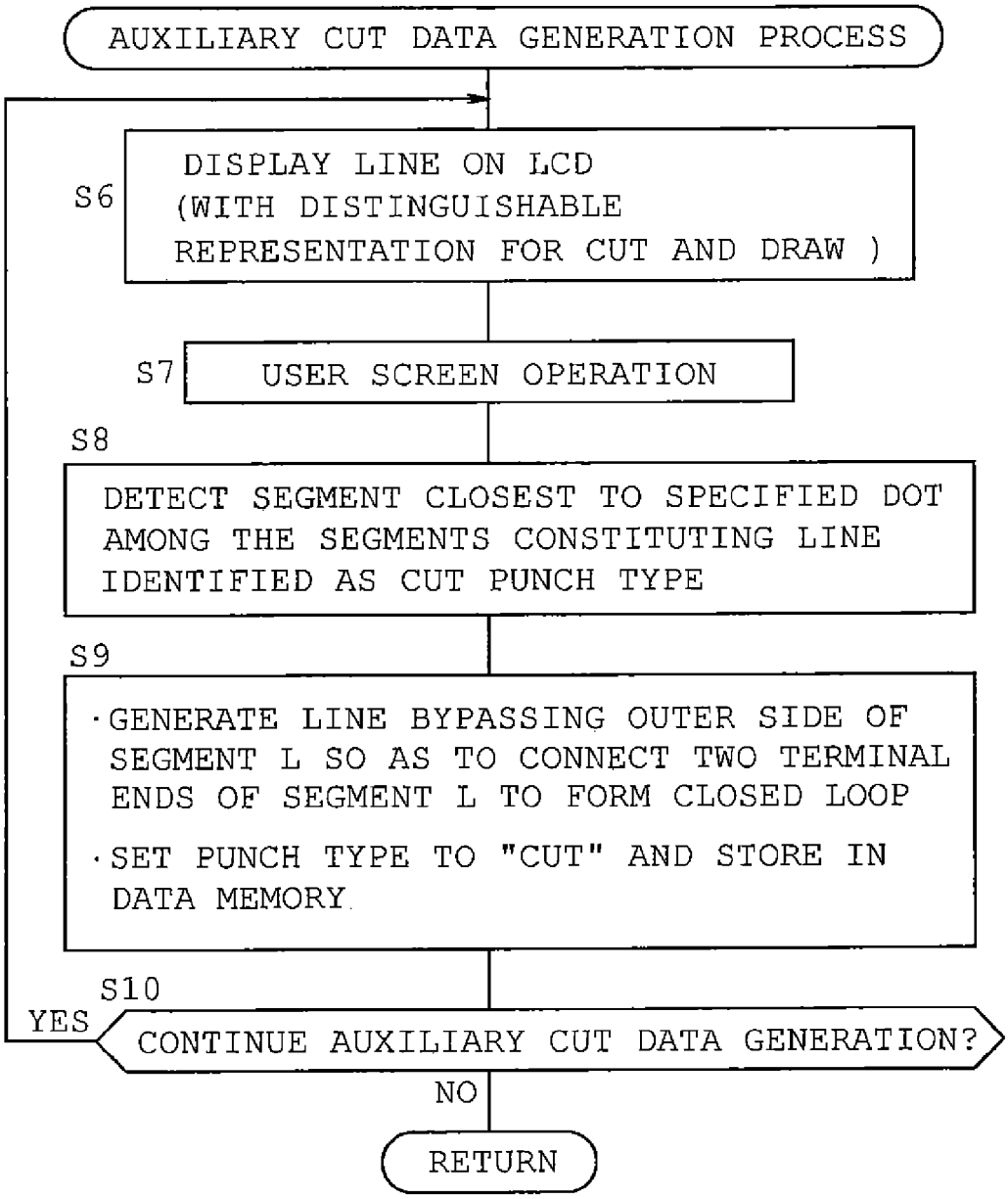
FIG. 14 is a flowchart detailing step S3 of the flowchart of FIG. 13.
Figure 16:
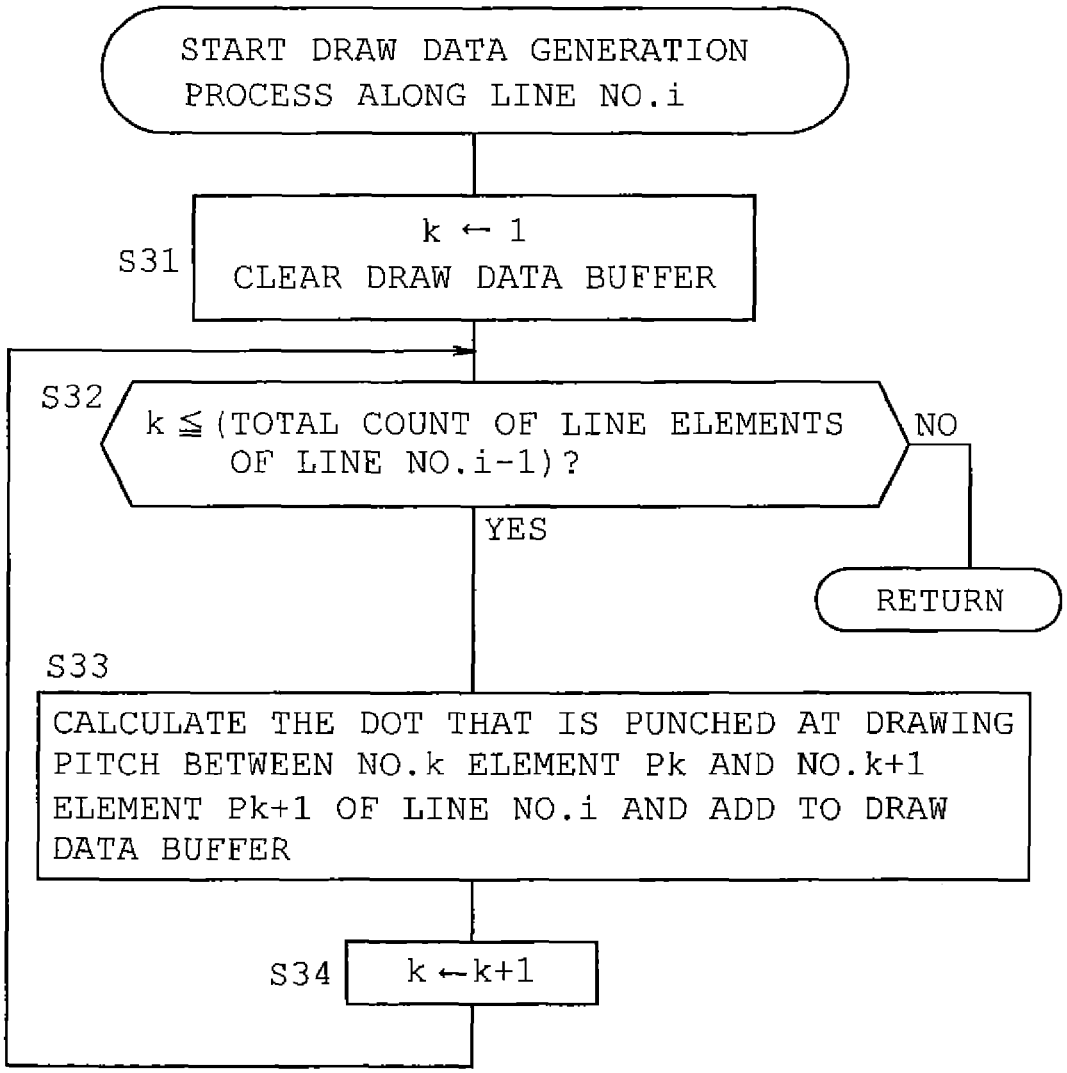
FIG. 16 is a flowchart detailing step S14 of the flowchart of FIG. 15.
Figure 17:
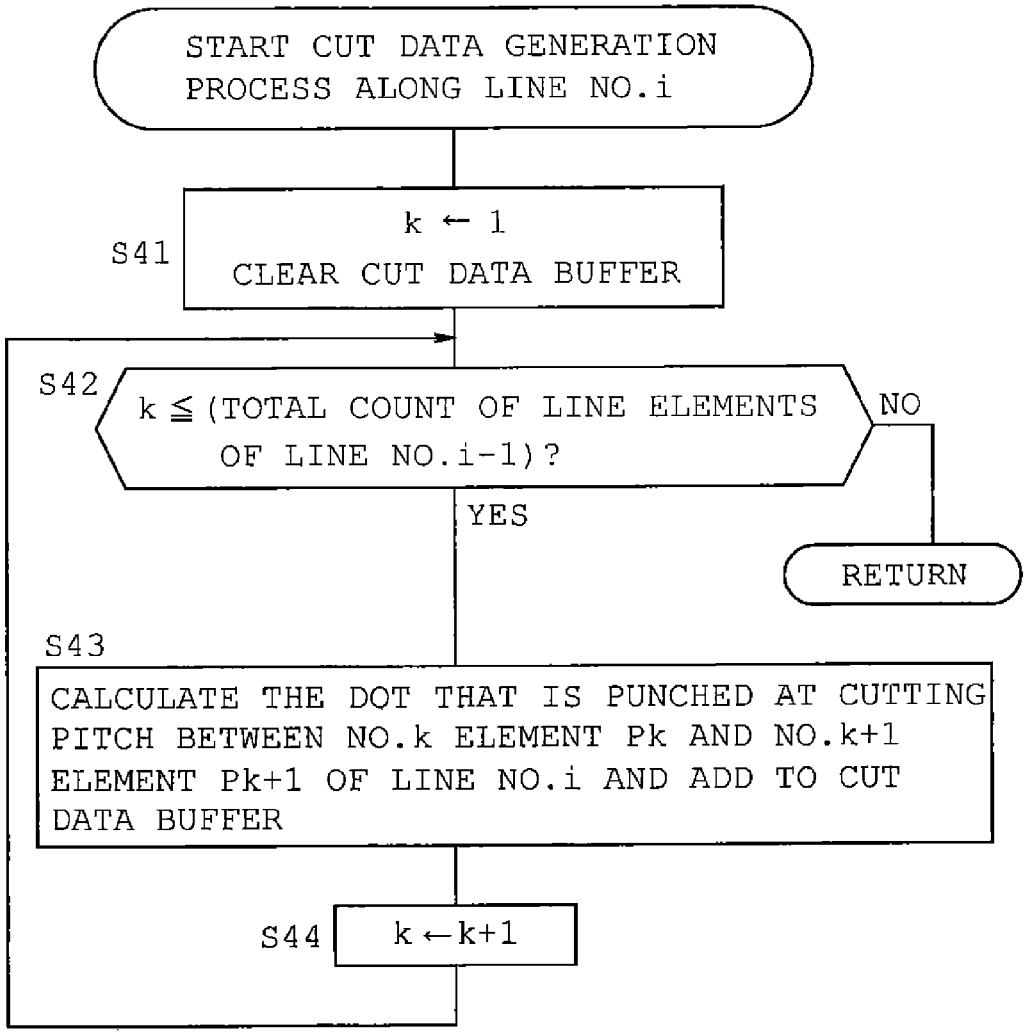
FIG. 17 is a flowchart detailing step S20 of the flowchart of FIG. 15.

Among them, flowchart of FIG. 13 indicates the main routine. The flowchart of FIG. 14 shows the details of the auxiliary cut data generation process identified as step S3 in FIG. 13. The flowchart of FIG. 15 indicates the punch data generation process identified as step S4 in FIG. 13. The flowchart indicated in FIG. 16 shows the details of the draw data generation process identified as step S14 in FIG. 15. The flowchart of FIG. 17 shows the details of the cut data generation process including the auxiliary cut data identified as step S20 in FIG. 15.

That is, as shown in FIG. 13, at step S1, line elements of the lines constituting the pattern are inputted to obtain the line data. This step is executed by displaying the image of character C on LCD 46 and allowing the user to specify the line elements through the screen. Alternatively, control circuit 41 may be configured to automatically extract the lines and their line elements. Step S1 is followed by step S2 in which the type of punch data is specified for each line, in this case, for line numbers 1 to 10. This task may also be automated. Line data as such indicated in FIG. 8A is obtained from steps S1 and S2.

Then, at step S3, auxiliary cut data generating process is executed. This process is detailed in the flowchart of FIG. 14 which begins with step S6 that displays the image of pattern comprising images of each of the lines constituting character C on the screen of LCD 46. As exemplified in FIG. 10, the image of patterns surrounded by the outline generated based on the draw data and the image of outlines generated based on the cut data of character C are represented differently so that they can be distinguished on the screen. Then, at step S7, the user specifies the location where cut E, that is, the through hole is to be formed through, for instance, the touch operation of the touch panel. If the user, for instance, wishes to form cut E on the outer side, in this case, the right side of the right ear of character C, the portion indicated by a1 in FIG. 10 is to be specified.

Then, at step S8, among the line data indicated in FIG. 8A categorized as cut data, the segment which runs between 2 adjacent line elements, and which is the nearest to the specified location is identified as segment L. For instance, if the portion indicated by a1 in FIG. 10 corresponding to the right side of the right ear of character C has been specified, segment connecting line elements P14 and P15 is identified as segment L from the line represented as line no. 4 in FIG. 12A.

Figure 12A:
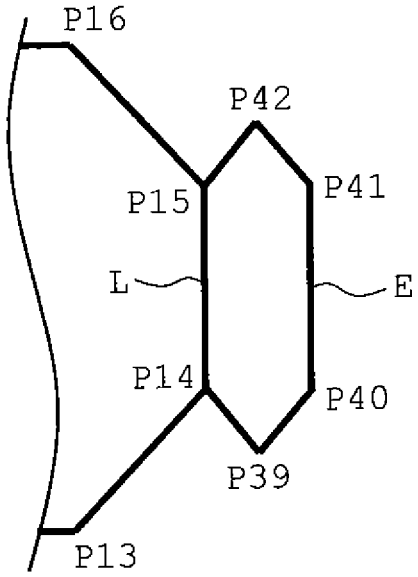
FIG. 12A shows a cut being specified on the outer portion of the right ear of the character.
Figure 12B:
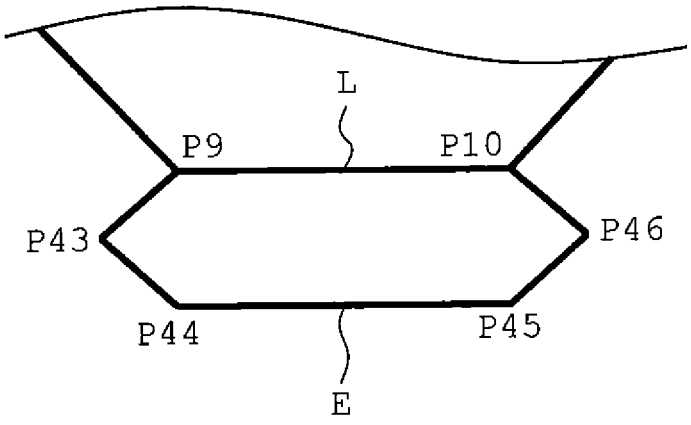
FIG. 12B shows a cut being specified on the lower portion of the face of the character.

Then, at step S9, new line elements that form an elongate hexagon, including segment L as one of its sides, is formed on the outer side of the outline, that is, segment L. Thus, closed hexagonal loop of segments running from one end of segment L to the other end of segment L is specified as cut E. The data of the newly generated line is appended to the data memory as line data categorized as cut data. In the example of FIG. 12A, 4 new line elements namely, P39, P40, P41, and P42 are specified whereby cut E running from P14, P39, P40, P41, P42, and P15 in the listed sequence are specified. As indicated in FIG. 8B, line data identified as Line no. 11 having line elements P14, P39, P40, P41, P42, and P15 is newly added as auxiliary cut data.

Step S10 determines whether or not to continue the generation of auxiliary cut data. If selected to continue by user operation (step S10: YES), steps from step S6 are repeated. In such case, at step S7, the user specifies the portion indicated by a2 in FIG. 10, for instance, which corresponds to the lower side of the face or the chin of character C. Responsively, 4 new line elements namely, P43, P44, P45, and P46 are specified, whereby cut E running from P9, P43, P44, P45, P46, and P10 is specified. Then, as indicated in FIG. 8B, line data identified as line no. 11 having line elements P9, P43, P44, P45, P46, and P10 is newly added as auxiliary cut data. When completing the generation of auxiliary cut data (step S10: No), the process returns to the flowchart of FIG. 13.

Referring back to FIG. 13, step S4 undertakes generation of all the punch data based on the line data obtained as described above. The punch data generation will be later described in detail when discussing flowchart of FIG. 15. If the type of punch data is the cut data or auxiliary cut data, the punch dots are positioned so that penetration H is formed at a smaller pitch of, for instance, 0.1 mm as compared to when the type of the punch data is the draw data in which penetration H is formed at, for instance, 0.2 mm. At step S5, the punch data including draw type, cut type, and auxiliary cut type punch data generated at step S4, which is a collection of position coordinates of the punch dots, is converted into stitch data to complete the punch data generation process. Stitch data, in this case, is transfer data representing stroke-by-stroke X-directional and Y-directional movement of holder 21 and consequently workpiece W held by holder 21.

Referring now to the flowcharts of FIGS. 15 and 17, the punch data generation process will be described in detail. The flowchart indicated in FIG. 15 begins with step S11 in which 1 is assigned to variable i that indicates the line number. Then, step S12 determines whether variable i is equal to or less than the total count of lines. In the example shown in FIG. 8B, the total count of lines amounts to 12. If variable i is equal to or less than the total count of lines (step S12: Yes), the process proceeds to step S13 which determines whether or not the $i^{th}$ line, or line number i is a draw type punch data. If determined to be a cut type punch data, in other words, cut punch type (step S13: No), the process proceeds to step S16 which increments variable i by 1 and returns the process flow back to step S12. If determined to be a draw type punch data, in other words, draw punch type (step S13: Yes), the process proceeds to step S14 and the draw data is generated for forming penetrations H along line no. i.

The draw data generation process executed at step S14 is broken down into sub steps in flowchart of FIG. 14. The flowchart begins with step S31 which assigns 1 to variable k that indicates the numbering for identifying a line element provided in a given line number i and clears the draw data buffer. Step S32 determines whether or not variable k is equal to or less than ("total count of line elements"−1). For instance, in line no. 2 of the examples shown in FIGS. 8A, 8B, and 9, "total count of line elements" amounts to 2, whereas in line no. 7, "total count of line elements" amounts to 7.

If variable k is equal to or less than ("total count of line elements"−1) (step S32: Yes), the process proceeds to step S33. Step S33 calculates the position of the punch dots arranged at pitch T, exemplified as 0.2 mm in the present exemplary embodiment, that resides on and between a given line element Pk and line element Pk+1 within line no. i and adds the calculated punch dots into the draw data buffer. As described earlier, line element Pk denotes line element no k and line element Pk+1 denotes line element no. k+1. The same denotation applies throughout the description when numberings of lines or elements are generalized by variables such as k and i. Step S34 increments variable k by 1 and returns the process flow to step S32. If variable k exceeds ("total count of line elements"−1) (step S32: No), the process is terminated. The above described process generates the draw data for sequential formation of multiplicity of penetrations H formed at pitch T along line no. i.

Figure 15:
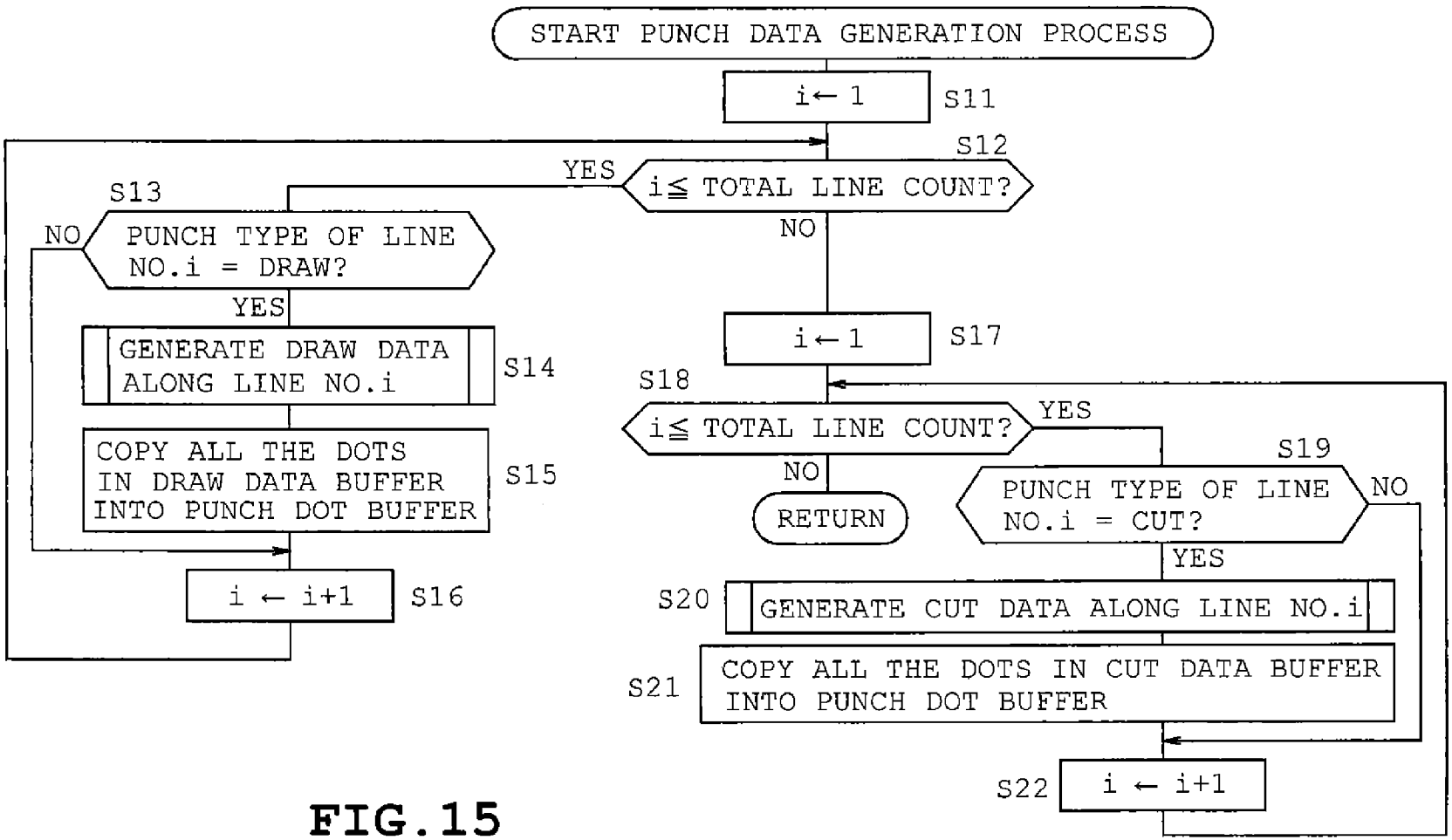
FIG. 15 is a flowchart detailing step S4 of the flowchart of FIG. 13.

The process flow, then, returns to FIG. 15, and proceeds to step S15 that copies all the draw data, representing the position data of multiplicity of punch dots, written into the draw data buffer into the punch dot buffer. Then, step S16 increments variable i by 1 and the process flow returns to step S12. By repeating step S12 onwards, the draw data is generated for lines identified as draw type punch data, in this case, lines no. 2, 5, 7, 8, 9, and 10 as exemplified in FIGS. 8A and 8B. When variable i exceeds the total count of lines, in this case, when i=13, step S12 makes a No decision and terminates the draw data generation process.

After completing the draw data generation process, the process proceeds to step S17 in which 1 is assigned to variable that indicates the numbering for identifying the lines and the subsequent step S18 determines whether or not variable i is equal to or less than the total count of lines.

If variable i is equal to or less than the total count of lines (step S18: Yes), the process proceeds to step S19 which determines whether or not line no. i is a cut type punch data. If determined to be a draw type punch data (step S19: No), the process proceeds to step S22 and returns to step S18 after incrementing variable i by 1. If line no. i is indeed a cut type data (step S19: Yes), the process proceeds to step S20 and the cut data is generated for forming penetrations H along line no.

The cut data generation process executed at step S20 is broken down into sub steps in the flowchart of FIG. 17. The flowchart begins with step S41 which assigns 1 into variable k that indicates the numbering for identifying a line element provided in a given line number i and clears the cut data buffer. Step S42 determines whether or not variable k is equal to or less than ("total count of line elements"−1). For instance, in line no. 1 of the examples shown in FIGS. 8B and 9, "total count of line elements" amounts to 8.

If variable k is equal to or less than ("total count of line elements"−1) (step S42: Yes), the process proceeds to step S43. Step S43 calculates the position of the punch dots arranged at pitch S, exemplified as 0.1 mm in the present exemplary embodiment, that resides on and between a given line element Pk and line element Pk+1 within line no and adds the calculated punch dots into the cut data buffer. Step S44 increments variable k by 1 and returns the process flow to step S42. If variable k exceeds ("total count of line elements"−1) (step S42: No), the process is terminated. The above described process generates the cut data for sequential formation of multiplicity of penetrations H spaced by S along line no. i.

The process flow returns to FIG. 15, and proceeds to step S21 that copies all the cut data, representing the position data of multiplicity of punch dots, written into the cut data buffer into the punch dot buffer. Then, step S22 increments variable by 1 and the process flow returns to step S18. By repeating step S18 onwards, the cut data is generated for lines identified as cut type punch data, in this case, lines no. 1, 3, 4, 6, 11, and 12. Line nos. 11 and 12 are considered as auxiliary cut data. When variable i exceeds the total count of lines, in this case, when i=13, step S18 makes a No decision and terminates the cut data generation process.

Thus, punch data is created that draws patterns within the bounds or outline of character C and that cuts character C along the outline, and that further forms cut E that assists the user when detaching the outline from workpiece W through formation of multiplicity of penetrations H on workpiece W. The punch data is a collection of stroke-by-stroke punch position of punch needle 10 which is an equivalent of collection of stroke-by-stroke movement amount of holder 21 in the X and Y directions. As described above, the punch data is generated such that suitable pitch is specified for formation of penetration H for the draw type punch data, the cut type punch data, and auxiliary cut data respectively.

During the punch data generation process, a screen is displayed on LCD 46 that shows an image of character C which is represented by multiplicity of penetrations H formed on workpiece W as exemplified in FIG. 10. The images of patterns based on the draw data and the images of outlines based on the cut data are represented differently on the screen. For instance, the pattern images based on the draw data are represented as a collection of broken lines having a length of certain extent, whereas the outline images based on the cut data are represented as a collection of small dots. Such distinction in the presentation of the draw data and the cut data provides good visibility to the user.

In addition to the execution of a normal sewing operation, multi-needle embroidery sewing machine 1 according to the present exemplary embodiment is capable of executing a penetration forming operation on workpiece W such as a sheet of paper by using the punch data generated as described above. In executing the penetration forming operation, the user is to attach punch needle 10 on the number 6 needle bar 8 as well as attaching holder 21 on frame holder 24. Then, the punch data of the desired pattern is selected and read to start the penetration forming operation.

In the present exemplary embodiment, control circuit 41 of multi-needle embroidery sewing machine 1 starts the penetration forming operation by activating sewing machine motor 15 provided that attachment of holder 21 to frame holder 24 has been detected. This means that the penetration forming operation is not permitted when attachment of embroidery frame 20 has been detected, in which case, an error alert is issued. Likewise, the attempt to execute an embroidery sewing operation with the attachment of holder 21 is not permitted and will similarly result in an error alert.

Based on the information provided in the punch data, control circuit 41 selectively drives the number 6 needle bar 8 having punch needle 10 attached to it by way of needle-bar selector motor 17 while moving holder 21 and consequently workpiece W in the X and Y directions through control of transfer mechanism 18. Thus, punch needle 10 is pierced through a predetermined position of workpiece W in the predetermined sequence according to the information provided in the punch data to form multiplicity of penetrations H on workpiece W as shown in FIG. 5A.

Figure 11:
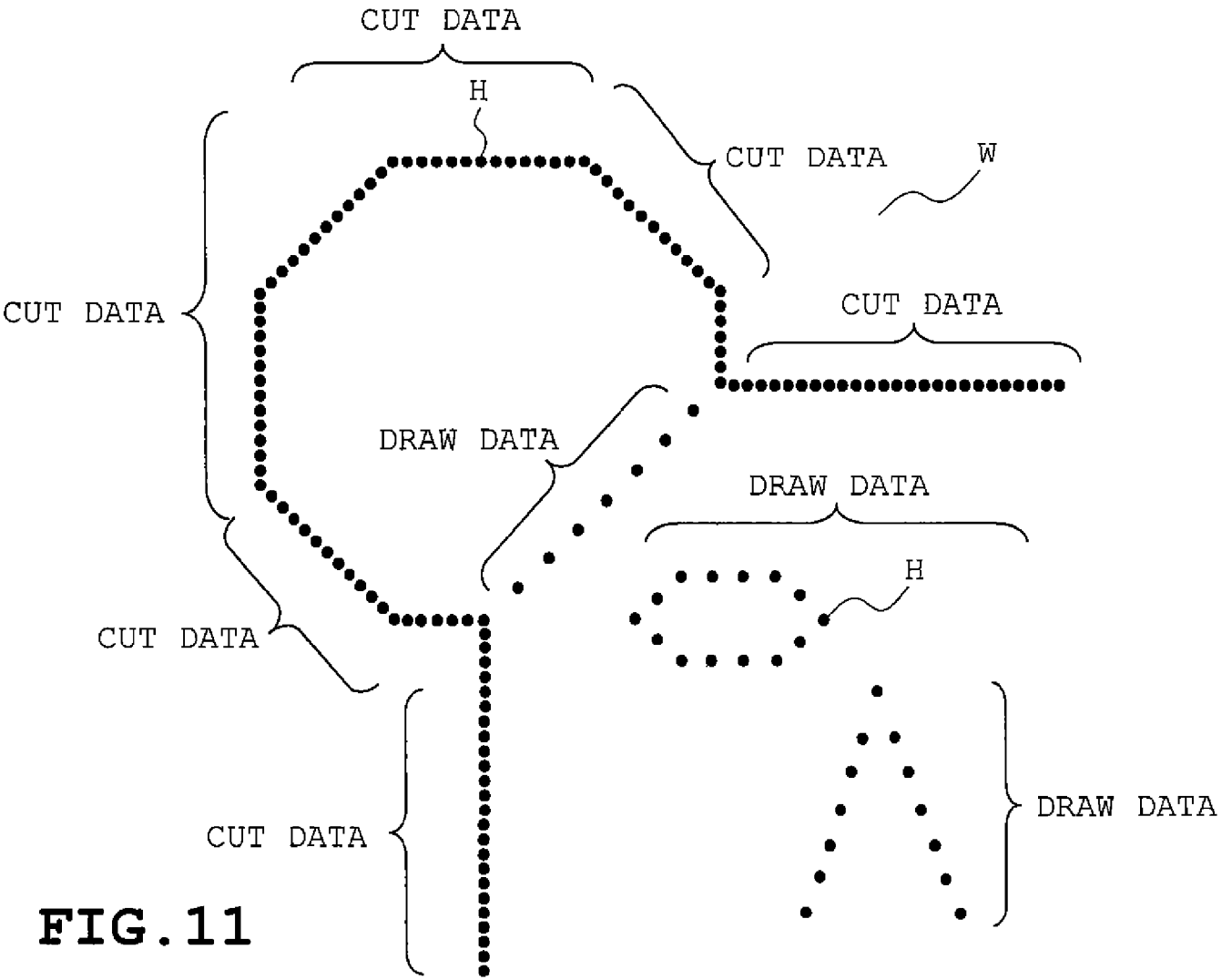
FIG. 11 is an enlarged view partially describing how the penetrations are formed on the workpiece.

As exemplified in the exploded view of the left ear portion of character C provided in FIG. 11, the penetration forming begins with formation of multiplicity of penetrations H on workpiece W in accordance with the information provided in the draw data to draw predetermined patterns, in this case, the facial elements such as the eyes, the nose, and the mouth of character C as well as the boundary between the face and the ears. Then, multiplicity of penetrations H are further formed consecutively along the outline of character C based on the cut data. Diameter ϕB indicating the size of penetration H is constant irrespective of whether it is formed for pattern drawing or outline cutting. The pitch at which penetrations H are formed varies depending on whether it is formed for pattern drawing or outline cutting, where a predetermined spacing is given between penetrations H formed for pattern drawing, whereas penetrations H formed in outline cutting is given no spacing between them, meaning that the adjacent penetrations H overlaps or is connected to one another. Thus, as the result of outline cutting, the collection of penetrations H exhibit a cut that extends along the outline of character C.

Further according to the present exemplary embodiment, multiplicity of penetrations H constituting cut E that assists the user in cutting apart the outline from workpiece W is formed adjacent to the outline of character C so as to reside on the outer side of the outline. Such penetrations H are interconnected with the neighboring penetrations H. As exemplified in FIG. 5A, 2 cuts E are formed on workpiece W such that one is located on the right side of the right ear outline of character C and the other is located on the lower side of the facial outline of character C. Especially because the present exemplary embodiment is arranged to form a closed loop with cut E and a portion of the outline cut, the portion of workpiece W located within the loop is cut off to form a through hole.

Thus, when the user removes the outline of character C from workpiece W after the penetrations have been formed, the user is allowed to insert his/her fingers into cut E, that is, the through hole to facilitate the user's task of removing character C from workpiece W. As a result, as shown in FIG. 5B, character C can be removed neatly from workpiece W without damaging or bending the outer peripheral portion of the outline. Because penetrations H are formed at greater pitch or spacing when formed based on the draw data as compared to those formed based on the cut data, patterns are drawn with greater reliability and accuracy to prevent any possibility of workpiece W being broken off at unwanted locations.

The present exemplary embodiment allows multi-needle embroidery sewing machine 1 to be utilized as a device to create patterns on a sheet of workpiece W and as a device to cut workpiece W into the desired shape through formation of penetrations H by applying punch needle 10. Because the above configuration does not require optional accessories such as cutter device or a separate cutting plotter, functional advantages offered by such additional devices can be achieved in less cost. Further, because the above configuration allows pattern drawing and cutting to be rendered in sequenced consecutive tasks without having to remove workpiece W during the transition from pattern drawing to cutting, no misalignment occurs between the drawn pattern and the outline along which the pattern is cut.

The present exemplary embodiment further allows multi-needle embroidery sewing machine 1 to function as a punch data generator being subdivided into a draw data generator for generating the draw data, cut data generator for generating the cut data, and auxiliary cut data generator for generating the auxiliary cut data. Such configuration advantageously allows generation of punch data that enables drawing of the desired pattern on workpiece W, cutting of workpiece W along the outline of the drawn pattern, and facilitating user's detachment of the pattern outline from workpiece W through formation of cut E.

Moreover, because the present exemplary embodiment is arranged to form through hole with cut E and a portion of the pattern outline such that the resulting through hole is sized to allow insertion of the user's finger, the detachment of pattern outline from workpiece W on the part of the user is made much easier. Further, because cut E can be formed on multiple locations of workpiece W and wherever specified by the user, the work can be even more streamlined. Still further, pitch S at which penetrations H are formed based on the cut data is configured to be less than pitch T at which penetrations are formed based on the draw data. Thus, appropriate cuts can be made reliably on workpiece W while advantageously only requiring a single type of punch needle 10.

Figure 18:
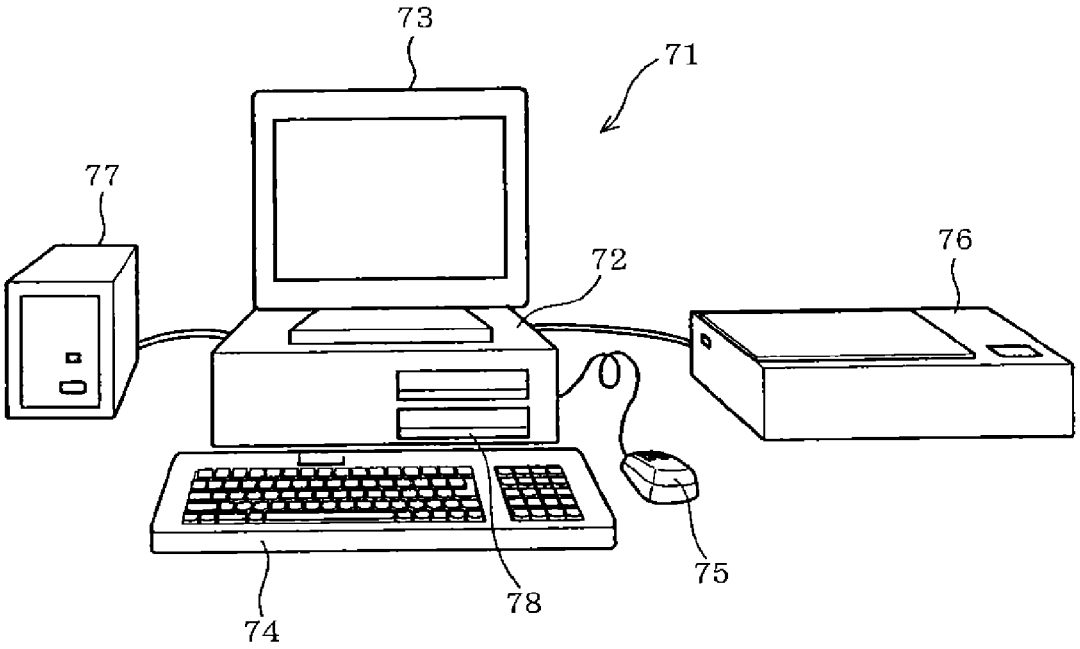
FIG. 18 is a perspective view showing an overall view of a punch data generating device according to a second exemplary embodiment.

FIG. 18 illustrates a second exemplary embodiment of the present disclosure and more particularly shows an overall view of punch data generating device 71. Punch data generating device 71 is configured in the form of a readily available system such as a personal computer system constituting a device independent of multi-needle embroidery sewing machine 1. The punch data generated by punch data generating device 71 is given to the multi-needle embroidery sewing machine 1. Punch data generating device 71 is configured by interconnection of generating device body 72, display 73 such as a color CRT (Cathode Ray Tube) display, keyboard 74, mouse 75, image scanner 76 capable of scanning color images, and external storage 77 such as a hard disc drive.

Generating device body 72 comprises a main body of a personal computer including components not shown in detail such as CPU, ROM, RAM, I/O interface, and optical disc drive 78 that reads data from and writes data into medium such as CD (Compact Disc) and DVD (Digital Versatile Disc), or more generally, optical disc. Punch data generating program may be pre-stored, for instance, into external storage 77, or may be stored in computer readable medium such as CD and DVD which is placed into optical disc drive 78 to be loaded for execution.

The punch data generating program, when executed, displays information on to display 73 such as images of patterns for which the punch data is generated and mandatory information for generating the punch data. By referring to the information shown on display 73, the user makes necessary inputs and issues instructions through key board 74 and mouse 75 operation. Further, image scanner 76 allows scanning of image data of original images of patterns for which punch data generation is intended. As an alternative to taking in scanned images by image scanner 76, the digitalized photograph images may be taken in which was captured by digital cameras, etc.

Through execution of the punch data generating program, the generating device body 72 generates the punch data for executing the penetration forming operation using multi-needle embroidery sewing machine 1 based on image data of original images of patterns scanned by the user through image scanner 76. The second exemplary embodiment also allows generating device body 72 to function as a draw data generator for generating the draw data, a cut data generator for generating the cut data, and the auxiliary cut data generator for generating the auxiliary cut data generator. Thus, punch data can be generated for both drawing of predetermined patterns on workpiece W as well as cutting of workpiece W along the outline of the drawn pattern while further facilitating detachment of the pattern outline from workpiece W.

FIGS. 19A to 19D each illustrates different exemplary embodiments of the present disclosure and each indicate third to seventh exemplary embodiments showing various forms of cut E formed adjacent to the outline on workpiece W. In the above described first exemplary embodiment, auxiliary cut data for forming auxiliary cut E was formed such that an elongate hexagonal loop having the outline, that is, segment L as one of its sides was formed by providing 4 additional line elements on the outer side of segment L. As opposed to this, in the example shown in FIG. 19A, cut E was formed such that a rectangle, in this case, an elongate trapezoid loop having segment L as one of its sides was formed by providing 2 additional line elements P47 and P48 on the outer side of segment L.

Figure 19A:
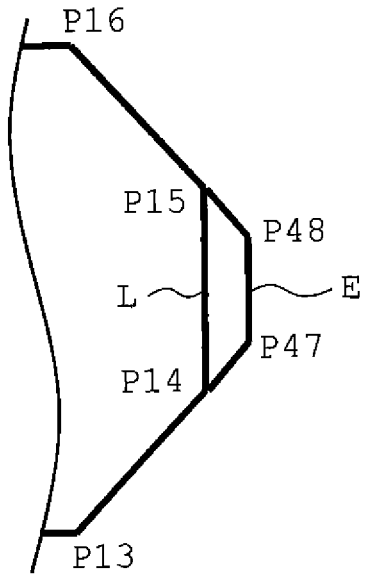
FIG. 19A illustrates a third exemplary embodiment showing a first variation of the cut.
Figure 19B:
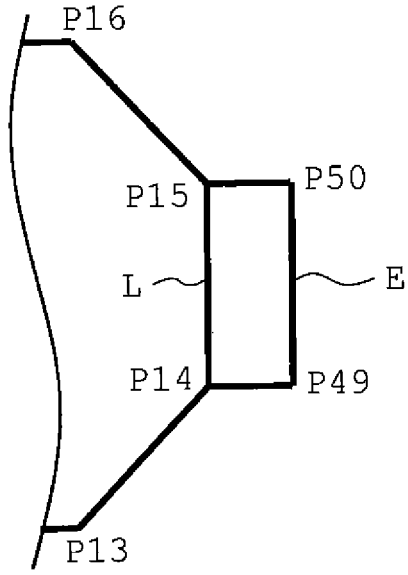
FIG. 19B illustrates a fourth exemplary embodiment showing a second variation of the cut.

Further, in the example shown in FIG. 19B, cut E is formed such that a square, in this case, an elongate rectangular loop having segment L as one of its sides was formed by providing 2 additional line elements P49 and P50 on the outer side of segment L. These modified examples are also capable of forming through holes with cut E and the outline, in other words, segment L which are sized at a width to allow insertion of the user's fingers. Auxiliary cut data may be formed such that cut E need not be a straight line or combination of straight lines but may be curved so as to exhibit an arc.

Figure 19C:
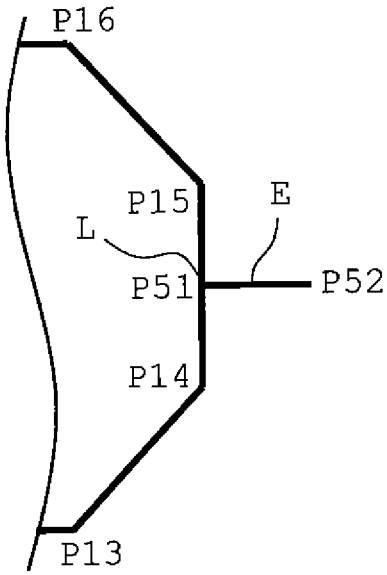
FIG. 19C illustrates a fifth exemplary embodiment showing a third variation of the cut.
Figure 19D:
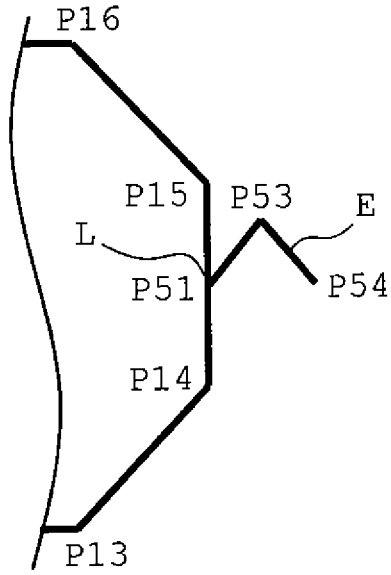
FIG. 19D illustrates a sixth exemplary embodiment showing a fourth variation of the cut.

Further, in the example shown in FIG. 19C, cut E simply extends outward in a straight line from the outline, in other words, segment L. In this example, line element 51 is newly specified to center on segment L running between line elements P14 and P15 while line element 52 is specified on its outer side so as to define cut E that extends orthogonal to segment L. In the example shown in FIG. 19D, line elements P53 and P54 are specified so as to form cut E that bends in a reverse V shape. Even if cut E is formed in a linear profile, it still successfully facilitates detachment of the outline from workpiece W.

The present disclosure is not limited to the exemplary embodiments described above but may be expanded or modified as follows.

Cut E was formed at 2 locations on the outer side of the outline in the first exemplary embodiment, but it may be formed at only 1 location or more than 3 locations. In such case, the location for forming cut(s) E need not be specified by the user but instead may be specified automatically by computer processing. Provision of cut E may be helpful if it is formed in places where the outline is acutely angled.

The draw data for drawing patterns on workpiece W was generated according to the configuration of the first exemplary embodiment. However, the process of draw data generation and consequently the pattern drawing may be eliminated to simply cut out the pattern along the outline based on cut data.

In each of the above described exemplary embodiments, punch data generating device has been configured to serve as control circuit 41 of multi-needle embroidery sewing machine 1 or was configured by a readily available personal computer. Alternatively, punch data generating device may be configured as a device that is connected directly or indirectly over a network with an embroiderable sewing machine or as a stand alone device for punch data generation.

In each of the above described exemplary embodiments, punch data generation was executed almost fully automatically by computer processing. However extraction of lines constituting the pattern or outline from the original image data, categorization of punch data type, and determining the sequence of penetration formation, etc. may be relied upon user input operation.

Still further, the embroiderable sewing machine may come in various configurations. For instance, the number of needle bars 8 provided in needle bar case 7 may be increased to 9 or 12. An embroidery sewing machine only provided with a single needle bar may be employed since penetrations can be formed by replacing the sewing needle with a punch needle. Various modifications are allowable throughout the configuration of multi-needle sewing machine 1, such as transfer mechanism 18, carriage 19, and holder 21 as long as they are true to the spirit of the present disclosure.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A punch data generating device that generates punch data for execution with an embroiderable sewing machine including a needle bar that is moved up and down and that is configured to allow attachment of a punch needle for forming a plurality of penetrations on a sheet of workpiece by piercing the workpiece in dot-by-dot strokes of the punch needle, a transfer mechanism that is configured to transfer the workpiece in two predetermined directions in coordination with an up and down movement of the punch needle to execute a penetration forming operation for forming the penetrations on the workpiece, the punch data generating device, comprising:

a cut data generator that generates cut data constituting the punch data, the cut data being configured to instruct sequential formation of the penetrations along an outline of a predetermined pattern to allow cutting of the outline; and an auxiliary cut data generator that generates auxiliary cut data constituting the punch data, the auxiliary cut data being configured to instruct sequential formation of the penetrations contacting the outline of the pattern to form a cut that facilitates detachment of the outline from the workpiece.

2. The device according to claim 1, wherein the auxiliary cut data is used for formation of a through hole comprising a portion of the outline of the pattern and the cut.

3. The device according to claim 2, wherein the through hole is sized to allow insertion of a user's finger.

4. The device according to claim 1, wherein the auxiliary cut data generator generates the auxiliary cut data to form a plurality of the cuts.

5. The device according to claim 1, wherein the auxiliary cut data generator generates the auxiliary cut data for use in a sewing device that uses at least one needle bar from a collection of multiple needle bars.

6. The device according to claim 1, wherein the auxiliary cut data generator generates the auxiliary cut data for use in a sewing device that is provided with a single needle bar, the penetrations being formed with the punch needle attached to the needle bar instead of a sewing needle.

7. The device according to claim 1, further comprising a specifier for specifying a location where the cut is to be formed, wherein the auxiliary cut data generator generates the auxiliary cut data such that the cut is formed at the location specified by the specifier.

8. The device according to claim 1, wherein the auxiliary cut data generator generates the auxiliary cut data such that the cut constitutes a portion of a polygonal through hole configured to be formed on the workpiece.

9. The device according to claim 1, wherein the auxiliary cut data generator generates the auxiliary cut data such that the cut extends outward in a straight line from the outline of the pattern.

10. The device according to claim 1, wherein the auxiliary cut data generator generates the auxiliary cut data such that the cut includes a bend.

11. The device according to claim 1, wherein the auxiliary cut data generator generates the auxiliary cut data such that the cut includes at least one straight line.

12. The device according to claim 1, wherein the auxiliary cut data generator generates the auxiliary cut data such that the cut defines an area enclosed by a plurality of lines.

13. A computer readable medium that stores a punch data generating program for generating punch data for execution with an embroiderable sewing machine including a needle bar that is moved up and down and that is configured to allow attachment of a punch needle for forming a plurality of penetrations on a sheet of workpiece by piercing the workpiece in dot-by-dot strokes of the punch needle, a transfer mechanism that is configured to transfer the workpiece in two predetermined directions in coordination with the up and down movement of the punch needle to execute a penetration forming operation for forming the penetrations on the workpiece, the punch data generating program, comprising:

instructions for generating cut data constituting the punch data, the cut data being configured to instruct sequential formation of the penetrations along an outline of a predetermined pattern to allow cutting of the outline; and instructions for generating auxiliary cut data constituting the punch data, the auxiliary cut data being configured to instruct sequential formation of the penetrations contacting the outline of the pattern to form a cut that facilitates detachment of the outline from the workpiece.

* * * * *